US011524196B2

(12) United States Patent
Hemphill et al.

(10) Patent No.: US 11,524,196 B2
(45) Date of Patent: Dec. 13, 2022

(54) CLIMBING ACTION STRUCTURES

(71) Applicant: Eldorado Wall Company, Inc., Louisville, CO (US)

(72) Inventors: Mark Hemphill, Erie, CO (US); Jason Thomas, Arvada, CO (US)

(73) Assignee: Eldorado Wall Company, Inc., Louisville, CO (US)

( * ) Notice: Subject to any disclaimer, the term of this patent is extended or adjusted under 35 U.S.C. 154(b) by 0 days.

(21) Appl. No.: 17/097,317

(22) Filed: Nov. 13, 2020

(65) Prior Publication Data

US 2021/0146184 A1 May 20, 2021

Related U.S. Application Data

(60) Provisional application No. 62/935,343, filed on Nov. 14, 2019.

(51) Int. Cl.
*A63B 9/00* (2006.01)
*A63B 71/04* (2006.01)

(52) U.S. Cl.
CPC ..... *A63B 9/00* (2013.01); *A63B 71/04* (2013.01); *A63B 2225/10* (2013.01)

(58) Field of Classification Search
CPC ..... A63B 9/00; A63B 71/04; A63B 2225/10; A63B 29/02; A63B 17/04; A63B 69/0048; A63B 2071/024; A63B 2225/05; A63B 2225/093; A63B 2225/74
See application file for complete search history.

(56) References Cited

U.S. PATENT DOCUMENTS 1,270,401 A * 6/1918 French ..... A63B 27/00 182/229
4,458,781 A * 7/1984 Ellis ..... A62B 1/10 182/8
4,815,727 A * 3/1989 Kiribuchi ..... A63B 9/00 182/178.1
4,997,064 A * 3/1991 Motte ..... A62B 35/0093 182/71
5,299,990 A * 4/1994 Mehlhoff ..... A63B 23/00 482/92
5,803,880 A * 9/1998 Allen ..... A63B 21/0087 482/37

(Continued)

*Primary Examiner* — Garrett K Atkinson
(74) *Attorney, Agent, or Firm* — Merchant & Gould P.C.

(57) ABSTRACT

A climbing action structure includes a support structure having a plurality of columns configured to be fixed relative to an underlying surface and support at least one header of a plurality of headers above the underlying surface. A climbing action space is defined between the columns, the headers, and the underlying surface that is devoid of intruding structure. The headers define a plurality of action element mounts, each defining a longitudinal axis substantially parallel to the underlying surface. At least one action element is removably coupled to the support structure at a respective action element mount. The action element includes a top end having a header connection member. The header connection member being coupled to the respective action element mount and adjustably positionable along the longitudinal axis, and the action element is disposed within the climbing action space and a participant has 360° access to the action element therein.

19 Claims, 17 Drawing Sheets

(56) References Cited

U.S. PATENT DOCUMENTS 6,083,142 A * 7/2000 Wilson ..... A63B 69/0048 482/37
6,390,952 B1 * 5/2002 Wilson ..... A63B 69/0048 182/71
6,786,830 B2 * 9/2004 Briggs ..... A63G 31/007 472/117
6,908,418 B2 * 6/2005 Saure ..... A63B 21/0552 482/904
7,727,118 B1 * 6/2010 McCall ..... A63B 21/00069 482/37
7,780,576 B1 * 8/2010 Sudeith ..... A63B 69/0048 482/904
8,038,581 B1 * 10/2011 Sudeith ..... A63B 71/06 482/37
8,197,392 B2 * 6/2012 Silverman ..... A63B 7/00 482/904
D673,236 S * 12/2012 Roberts ..... D21/827
8,821,359 B1 * 9/2014 Kassel ..... A63B 21/0557 482/904
9,132,330 B2 * 9/2015 Brendle ..... A63B 23/03541
9,220,966 B2 * 12/2015 Garner ..... A63B 69/187
9,370,685 B2 * 6/2016 Watry ..... A63B 21/4035
9,504,871 B2 * 11/2016 Munoz ..... A63B 21/16
9,630,043 B2 * 4/2017 Foster ..... A63B 21/156
9,867,452 B1 * 1/2018 Martinez ..... A47C 1/146
9,868,008 B2 * 1/2018 Todokoro ..... A63B 9/00
10,272,286 B2 * 4/2019 Liao Lai ..... A63B 22/04
10,328,302 B2 * 6/2019 Yeh ..... A63B 22/0056
10,507,349 B2 * 12/2019 Watson ..... A63B 17/04
11,045,678 B1 * 6/2021 Dattner ..... A63G 31/00
11,058,909 B2 * 7/2021 Adams ..... A63B 21/0783
11,077,329 B2 * 8/2021 Jones ..... A63G 31/00
11,090,543 B2 * 8/2021 Meyer ..... A63B 21/00069
2002/0091041 A1 * 7/2002 Mantooth ..... A63B 21/4035 482/35
2004/0014529 A1 * 1/2004 Briggs ..... A63G 31/007 472/128
2004/0087420 A1 * 5/2004 Montesquieux ... A63B 21/1636 482/121
2004/0238277 A1 * 12/2004 Kruse ..... A63B 29/02 182/36
2005/0059503 A1 * 3/2005 Briggs ..... A63B 9/00 472/128
2007/0175698 A1 * 8/2007 Keth ..... A62B 1/14 182/8
2008/0185221 A1 * 8/2008 Postma ..... A63B 69/0048 700/80
2011/0319230 A1 * 12/2011 Brendle ..... A63B 21/4013 482/37
2012/0035031 A1 * 2/2012 Silverman ..... A63B 21/1645 482/139
2012/0202660 A1 * 8/2012 Silverman ..... A63B 21/1645 482/131
2016/0089577 A1 * 3/2016 Boyer ..... A63B 22/18 472/135
2016/0250508 A1 * 9/2016 Todokoro ..... F16B 7/0446 482/35
2016/0325130 A1 * 11/2016 Grund ..... A63B 7/085
2016/0361660 A1 * 12/2016 Hreniuk-Mitchell ..... A63B 69/0048
2018/0185690 A1 * 7/2018 Coulter ..... A63B 71/03
2019/0032335 A1 * 1/2019 Sudeith ..... E04G 25/061
2019/0111295 A1 * 4/2019 Watson ..... F16B 21/12
2019/0358551 A1 * 11/2019 Hreniuk-Mitchell ..... A63G 21/16
2021/0101061 A1 * 4/2021 Pell ..... A63B 69/0048
2021/0275888 A1 * 9/2021 Speed ..... A63B 24/0003
2022/0054877 A1 * 2/2022 Cylvick ..... A63B 69/0048
2022/0072357 A1 * 3/2022 Bentsen ..... A63B 69/0048
2022/0080252 A1 * 3/2022 Sharp ..... A63G 9/12

* cited by examiner

CLIMBING ACTION STRUCTURES

INTRODUCTION

This application claims the benefit of and priority to U.S. Provisional Application No. 62/935,343, filed Nov. 14, 2019, the disclosure of which is hereby incorporated herein in its entirety.

INTRODUCTION

Climbing walls (e.g., indoor or outdoor) typically have a steel substructure that is covered by one or more panels, which can be shaped and colored to look like natural rock. Various climbing holds are attached to the panel for a participant to use and climb up the climbing wall. These holds can be selectively arranged so as to define the difficulty of the route for the participant. In some examples, these climbing walls may define a lower height (e.g., around 14 feet) so that the participants can climb without the need of a rope. This activity is often called bouldering. In other examples, participants can be attached to a rope so that participants can climb to upper heights. The rope may be attached to a belayer at one end to support and lower the participant. In another example, the rope may be attached to an auto-belay device that is supported at an upper portion of the climbing wall. The substructures of the climbing walls are mounted to existing structures, and thus, often require structural support modification so that it is difficult to modify and update. Additionally, climbing walls allow climbing access to only one side of the wall. Improvement to climbing structures are desirable.

SUMMARY

This disclosure describes examples of climbing action structures that have a support structure configured to support a plurality of action elements for a participant (e.g., climber) to climb on. The support structures support the action elements in such a way that the participants have full 360° access to each of the action elements. Additionally, the coupling between the action elements and the support structure enable the action elements to be easily removable so that the action elements can be changed out or repaired as required or desired without disassembling the support structure. The action elements are also repositionable relative to the support structure so that the climbing action structure can accommodate a variety of shapes and sizes of the action elements. The support structure also forms a number of locations that belay devices can be supported on so as to provide safety systems for the participants on the action elements. Two or more climbing action structures can also be coupled together and form horizontal action elements for the participants.

In an aspect, the technology relates to a climbing action structure including: a support structure including a plurality of columns and a plurality of headers, the plurality of columns configured to be fixed relative to an underlying surface and support at least one header of the plurality of headers above the underlying surface, and a climbing action space is defined at least partially between the plurality of columns, the plurality of headers, and the underlying surface that is devoid of intruding structure, wherein the plurality of headers define a plurality of action element mounts, each of the plurality of action element mounts define a longitudinal axis substantially parallel to the underlying surface; and at least one action element configured to be removably coupled to the support structure at a respective action element mount of the plurality of action element mounts, wherein the at least one action element includes a top end having a header connection member, the header connection member being coupled to the respective action element mount and adjustably positionable along the longitudinal axis, and wherein the at least one action element is disposed within the climbing action space and a participant has 360° access to the at least one action element therein.

In an example, the plurality of headers also define a plurality of belay sections configured to support a belay device for the participant, and at least one belay section of the plurality of belay sections are disposed adjacent the respective action element mount along the longitudinal axis. In another example, the header connection member includes a pair of upper brackets disposed above the respective action element mount and a pair of lower brackets disposed below the respective action element mount, and the header connection member couples to and is removed from the respective action element mount without disassembly of the support structure. In yet another example, the at least one action element extends between the respective action element mount and the underlying surface, and is oriented substantially orthogonal to the longitudinal axis. In still another example, the at least one action element includes a bottom end having a base connection member, the base connection member including a base plate to fix the at least one action element to the underlying surface and a post that lifts the bottom end off the underlying surface. In an example, the at least one action element includes a bottom end and a plurality of climbing features disposed between the top end and the bottom end.

In another example, the plurality of climbing features include a first set of climbing features and a different second set of climbing features, the first set and second set of climbing features being interchangeable on the at least one action element. In yet another example, the at least one action element is fixed relative to the support structure and one or more of the plurality of climbing features are movable relative to the at least one action element. In still another example, the top end and the bottom end of the at least one action element is fixed relative to the support structure, and at least a portion of the at least one action element is movable relative to the top and bottom ends. In an example, the at least one action element includes a first action element and a second action element, and the plurality of climbing features are different between the first and second action elements.

In another aspect, the technology relates to a climbing action structure including: a support structure including a plurality of action supports, each action support included: a base; a header; and a column extending between the base and the header, wherein the header is cantilevered from the column and a climbing action space is defined at least partially between the base, the header, and the column that is devoid of intruding structure, and wherein the header is substantially parallel to the base; and an action element configured to be removably coupled to the support structure at a respective action support of the plurality of action support, wherein the action element is coupled directly between the base and the header within the climbing action space, and is offset from the column so that a participant has 360° access to the action element.

In an example, the action element includes a top end having a header connection member and an opposite bottom end having a base connection member, and the header connection member and the base connection member allow for the action element to be slidably positioned at any location along a length of the header. In another example, the support structure is freestanding. In yet another example, each of the plurality of action supports extend radially outward from a center point such that each action element is circumferentially spaced from one another. In still another example, a free end of the header includes an end plate configured to support a belay device for the participant.

In an aspect, the technology relates to an action tower including: a freestanding support structure, wherein the support structure defines a plurality of action element mounts; a plurality of action elements configured to couple to the freestanding support structure at a respective action element mount of the plurality of action element mounts, wherein each of the plurality of action elements are supported at top and bottom ends, wherein each of the plurality of action elements are interchangeable with one another at the respective action element mount, and wherein each of the plurality of action elements are spaced apart from one another such that the attached action element is accessible from all sides within the freestanding support structure; and a plurality of vertical activity features disposed on the plurality of action elements that are configured to allow access between the top and bottom ends, wherein the plurality of vertical activity features are interchangeable on the plurality of action elements to vary a participant's access to the plurality of action elements.

In an example, at least one of the plurality of action elements includes a substantially rectangular panel, the substantially rectangular panel having two opposing surfaces configured to receive at least some of the plurality of vertical activities. In another example, the at least some of the plurality of vertical activities pivot, rotate, or spin relative to the substantially rectangular panel. In yet another example, the respective action element mount includes at least one belay section configured to support a belay device proximate the attached action element of the plurality of action elements. In still another example, the freestanding support structure is greater than or equal to 14 feet in height.

These and various other features as well as advantages that characterize the climbing action structures, support structures, and action elements described herein will be apparent from a reading of the following detailed description and a review of the associated drawings. Additional features are set forth in the description which follows, and in part will be apparent from the description, or may be learned by practice of the technology. The benefits and features of the technology will be realized and attained by the structure particularly pointed out in the written description and claims hereof as well as the appended drawings.

It is to be understood that both the foregoing introduction and the following detailed description are exemplary and explanatory and are intended to provide further explanation of the invention as claimed.

BRIEF DESCRIPTION OF THE DRAWINGS

The following drawing figures, which form a part of this application, are illustrative of described technology and are not meant to limit the scope of the invention as claimed in any manner, which scope shall be based on the claims appended hereto.

DETAILED DESCRIPTION

Climbing action structures and action towers are described herein. Support structures can be configured in different layouts and provide structural support for one or more action elements that are removably coupled thereto. The connection members that couple the action elements to the support structure can be standardized so that the efficiencies of manufacturing and changing out the action elements on the climbing action structure are increased. The action elements are spaced apart from each other so that climbing action spaces are defined for the action elements and full 360° access is provided for participants to each of the action elements. By making the action elements modular, it is easy to swap out and interchange the action elements and keep the climbing action structure new and exciting without requiring disassembly of the support structure. Furthermore, the support structure can be configured to fit in a wide variety of facilities, indoor or outdoor, and without needing to tie into an existing structure. The action elements can include any number of vertical activity or climbing features that add-on and allow the participant to climb between the top and bottom ends. These add-on features can be interchangeable on the plurality of action elements to vary a participant's access with respect to the action elements and can include static, interactive, and/or moveable features.

Throughout this description, references to orientation (e.g., front(ward), rear(ward), top, bottom, back, right, left, upper, lower, etc.) of climbing action structures, support structures, and action elements relate to their position when installed on the underlying ground surface and are used for ease of description and illustration only. No restriction is intended by use of the terms regardless of how the systems are situated.

Figure 1:
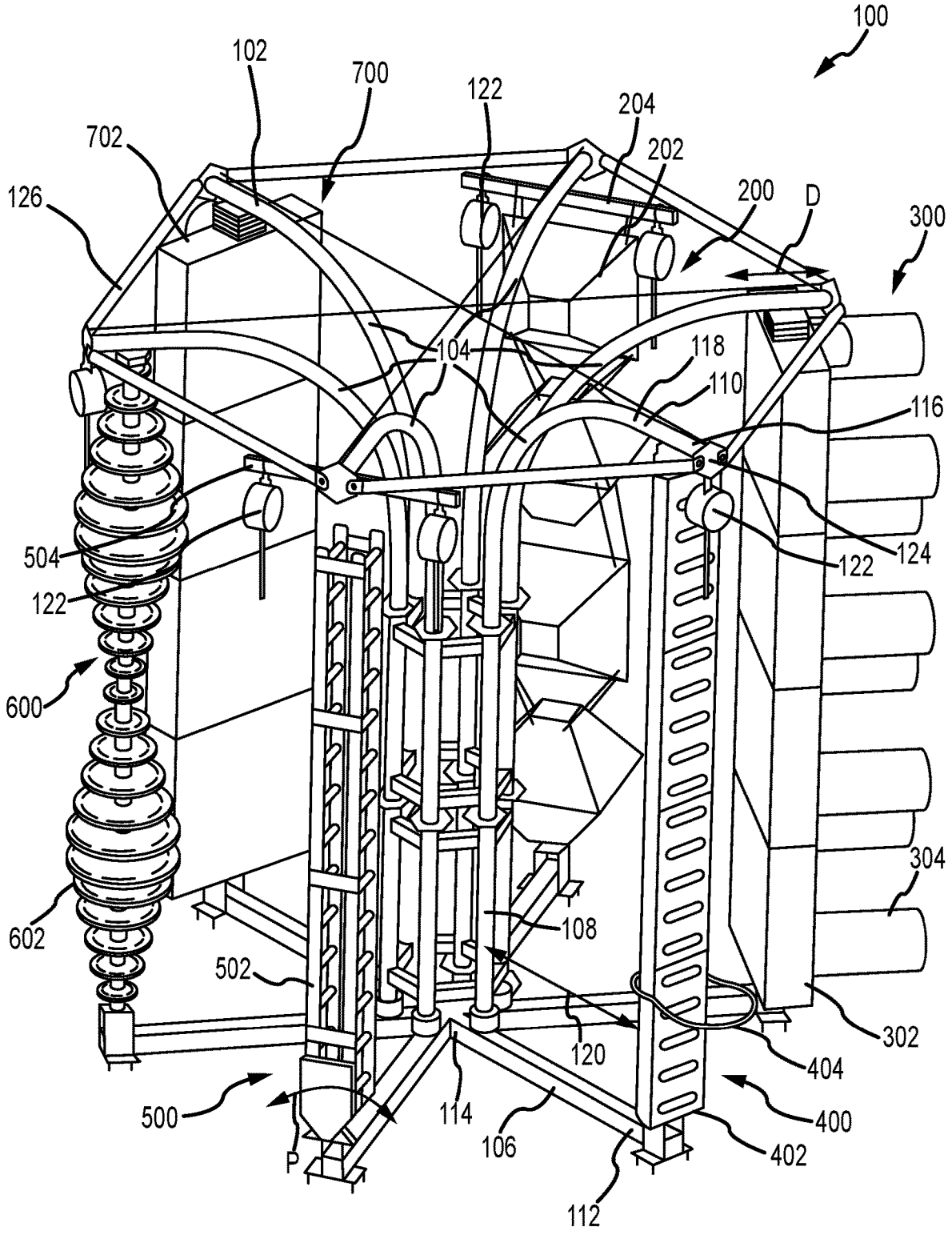
FIG. 1 is a perspective view of an exemplary climbing action structure having a plurality of action elements.

FIG. 1 is a perspective view of an exemplary climbing action structure 100 having a plurality of action elements 200, 300, 400, 500, 600, 700. The climbing action structure 100, also known as an action tower, allows participants (e.g., climbers) to interact and use its features for any number of activities. As used herein, activities include any type of vertical and/or horizontal movement on the structure 100, for example, climbing or other type of vertical movement using one or more features, rappelling or other descending movement using belay features, zip-lining or any other horizontal climbing movement across one or more structures. It should be appreciated that any activity can be under the participant's own strength and power or can be movement assisted.

The climbing action structure 100 includes a support structure 102 that is configured to support each of the action elements. In the example, the support structure 102 defines a plurality of action supports 104 that each of the action elements are supported by. Each action support 104 includes a base 106, a column 108, and a header 110. The base 106 has a first end 112 and an opposite second end 114. The first end 112 of the base 106 is configured to support the action element and the second end 114 of the base 106 is coupled to the column 108. The header 110 also has a first end 116 and an opposite second end 118. The first end 116 of the header 110 is configured to support the action element and the second end 118 of the header 110 extends from the column 108. The column 108 extends between the base 106 and the header 110 and at least partially defines the height of the climbing action structure 100.

Figure 5:
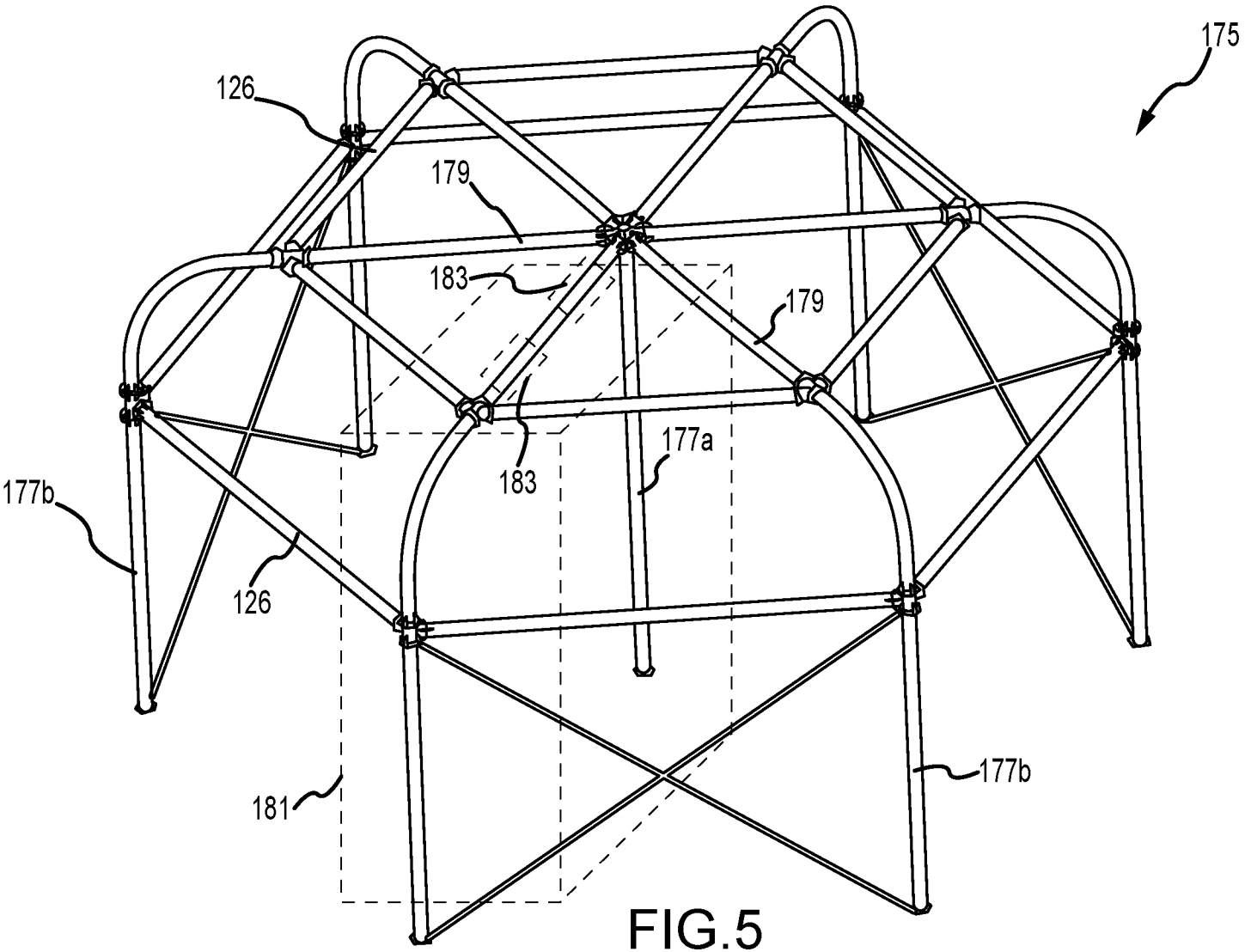
FIG. 5 is a perspective view of yet another example of a support structure.
Figure 6:
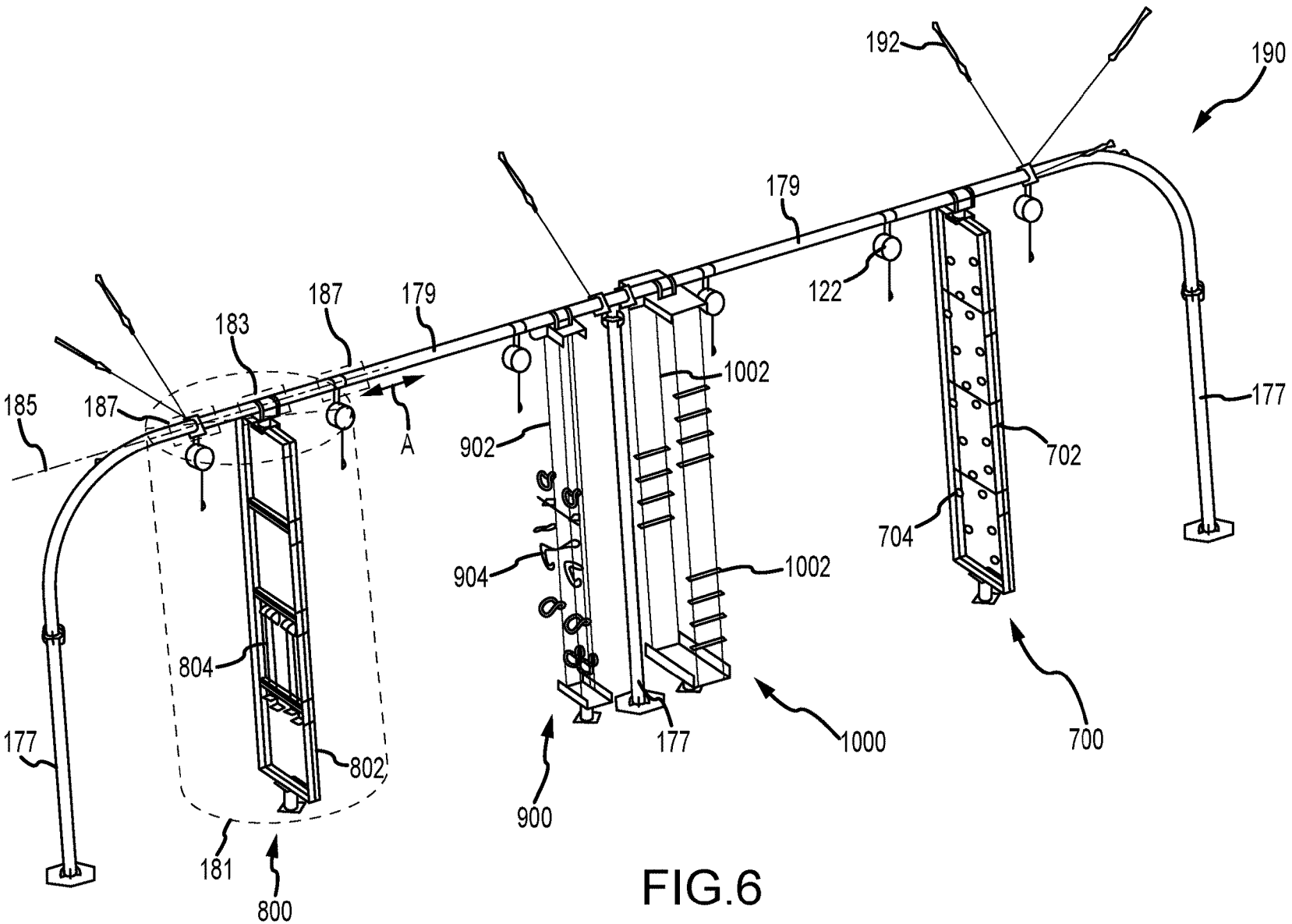
FIG. 6 is a perspective view of still another example of a support structure having a plurality of action elements.

In the example, the support structure 102 includes six circumferentially spaced action supports 104. Each of the action supports 104 extend radially outward from a center point. As such, each column 108 is positioned proximate the center and the bases 106 and headers 110 extend radially outwardly and at approximately 60° from one another, giving the support structure 102 a tree-like shape. It should be appreciated, that the support structure 102 can take any other shape that enables use of the action elements as described herein. For example, the support structure 102 may have five circumferentially spaced action supports 104. Any other number of action supports 104 can also be used as required or desired, e.g., two (shown in FIG. 4), three, four, seven, eight, etc. In another example, the support structure 102 can take a more canopy-like shape as shown in FIG. 5 or an arch-like shape as shown in FIG. 6. In an aspect, components of the support structure 102 (e.g., columns, headers, bases, etc.) are sized and shaped so that they are interchangeable between the different types support structures and can be utilized in different configurations as required or desired.

Each of the action elements are supported directly between the base 106 and the header 110 of the action support 104. As such, the action element is substantially parallel to the column 108 of the action support 104 and substantially orthogonal to the base 106. The action element is coupled proximate the first end 112 of the base 106 and the first end 116 of the header 110 so that the action element is radially spaced apart from the column 108 and an offset gap 120 is formed between the column 108 and the action element. The gap 120 enables participants to access climbing or activity features on a radially inner side (e.g., rear side) of the action elements in addition to the radially outer side (e.g., front side). Furthermore, the circumferential spacing of the action elements enables participants to access features on the left and right sides of the action elements as well. As such, the climbing action structure 100 allows for full 360° access to each of the action elements.

The first end 112 of the base 106 is substantially parallel to the first end 116 of the header 110. This parallel orientation of the base 106 and the header 110 extends for a distance D and allows for the action elements to be coupled to the action support 104 and selectively positioned within this distance D. As such, the action elements can be radially positioned on the action support 104 so as to accommodate specific sizes and connection elements. For example, smaller action elements can be attached closer to the first ends 112, 116 and larger action element can be attached further away from the first ends 112, 116 and the radially outer sides of the action elements to be aligned (e.g., for auto-belay positioning).

The action elements can take a variety of shapes and sizes, and have any number of climbing or activity features as required or desired. This includes the action elements described herein or those developed in the future. As such, the action elements coupled to the support structure 102 can be the same or different as required or desired. In the example, action element 200 includes a plurality of floating volumes 202 that are coupled together by one or more ropes. Action element 200 is described further below in reference to FIG. 7. The action element 300 includes a panel 302 with a plurality of selectively rotatable rollers 304. Other holds, volumes, and/or kinetic or static features may be releasably coupled to the panel 302 as required or desired. Action element 300 is described further below in reference to FIG. 8. The action element 400 includes a log structure 402 with a lasso 404. Action element 400 is described further below in reference to FIG. 9. The action element 500 includes a ladder structure 502 that is pivotable P. Action element 500 is described further below in reference to FIG. 10. The action element 600 includes a plurality of stacked disks 602 of various sizes, each of which spin within a bounded range of angles, for example, about 120°. The action element 600 allows the disks 602 to be reconfigured as required or desired and allows for two or more participants to use the action element. The action element 700 also includes a panel 702. The panel 702 may be the same or similar to the panel 302, however, the panel 702 includes other climbing or activity feature add-ons (not shown) such as a plurality of climbing holds. Action element 700 is described further below in reference to FIG. 11. It should be appreciated that the panels 302, 702 can support any number of features as required or desired. Further examples of action elements are also described below in reference to FIGS. 14-18.

To provide safety support for the participant, one or more belays 122 can be attached to the support structure 102 proximate the action elements. In the example, auto-belays are used, such as auto-belays from HeadRush Technologies of Boulder, Colo. or Perfect Descent of Littleton, Colo. In other examples, a belay bar or double point anchor can be used for manual belay using a rope. The belay 122 can be coupled to the action support 104 itself. For example, the first end 116 of the header 110 can include an end plate 124 with one or more belay couplings. In another example, a cantilever bar (not shown) can extend from the end plate 124 so as to position the belay 122 further out from the action element and prevent rope rub against the climbing or activity features. In yet another example, the belay 122 can be coupled to the header 110. For example, with a prusik loop that can slide longitudinally along the header 110. In still another example, two belays 122 can be coupled to the header 110 so that participants can climb on the inside and outside of the action element. Additionally, or alternatively, the belay 122 may be coupled to the action element itself. For example, action elements 200 and 500 include a belay support 204, 504 so that the belay 122 is on the left and right sides of the action elements.

In the example, crossbars 126 may extend between the first ends 116 of the headers 110 of each of the action support 104 so as to provide lateral support members on the support structure 102. In some examples, these crossbars 126 can be used to support one or more belays 122 as required or desired.

Figure 2:
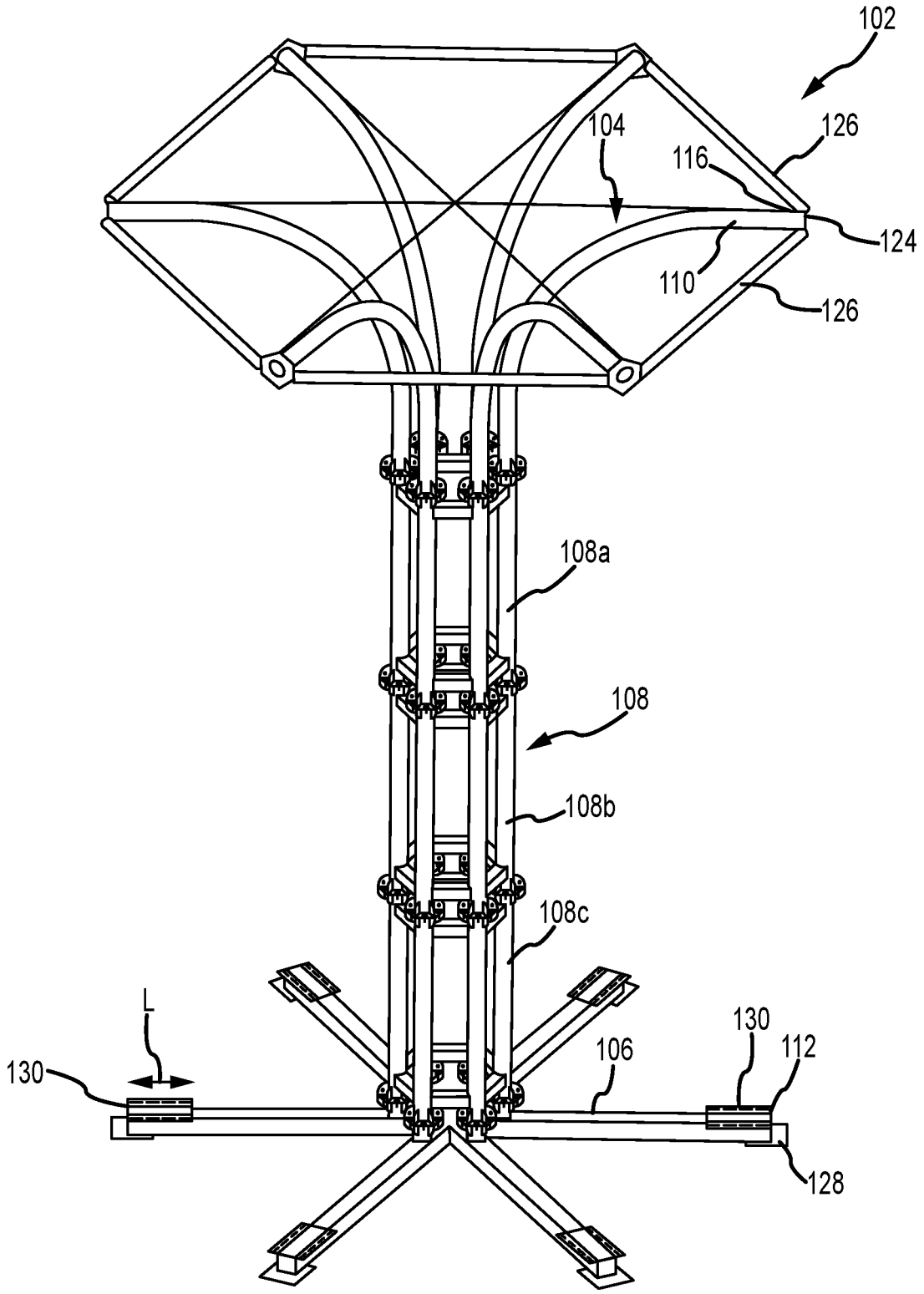
FIG. 2 is a perspective view of a support structure of the climbing action structure shown in FIG. 1.
Figure 3:
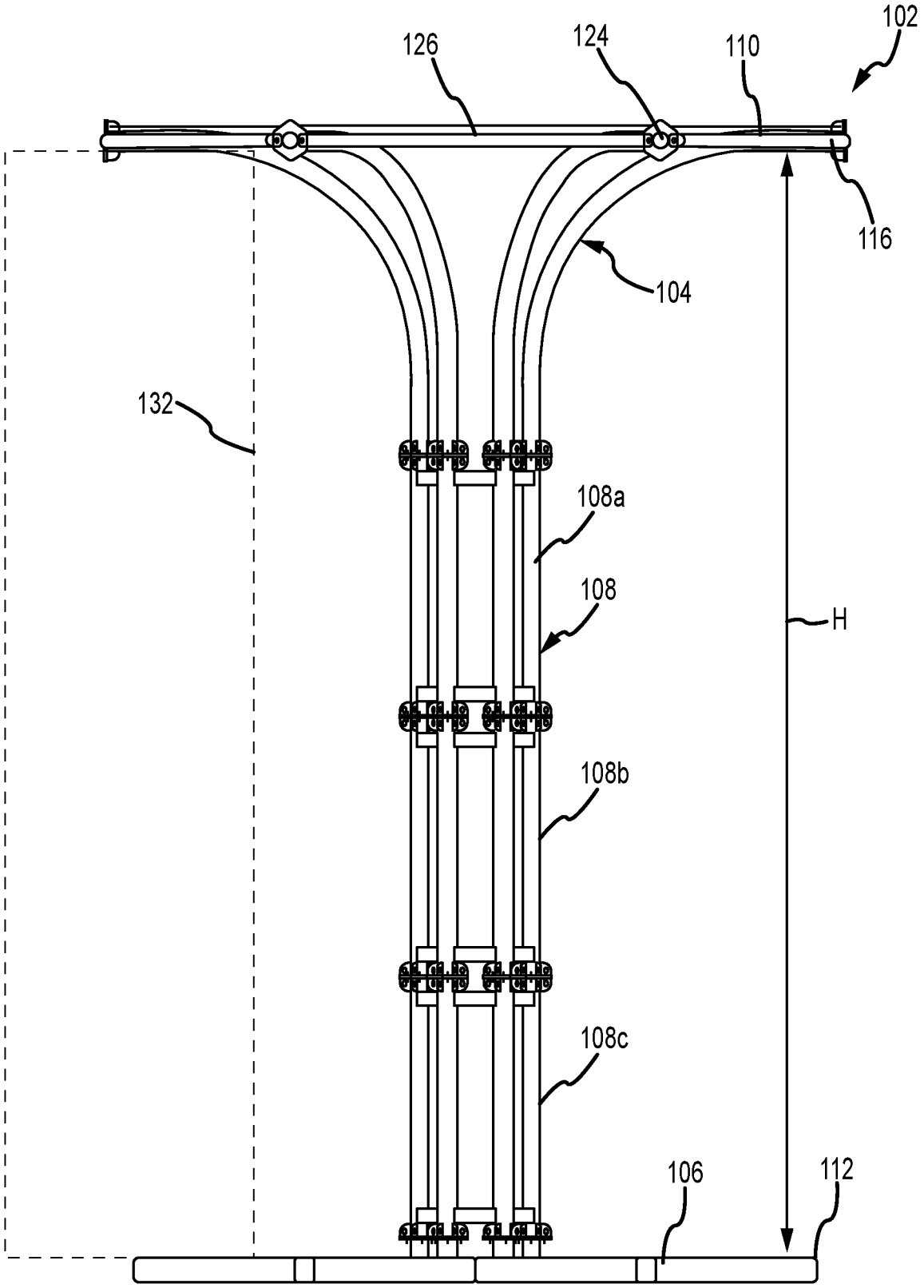
FIG. 3 is an elevation view of the support structure shown in FIG. 2.

FIG. 2 is a perspective view of the support structure 102 of the climbing action structure 100 (shown in FIG. 1). FIG. 3 is an elevation view of the support structure 102. Referring concurrently to FIGS. 2 and 3, certain components are described above, and thus, are not necessarily described further. The support structure 102 is freestanding so that supports for each action element do not need to be individually designed, and structural modification to buildings that house the climbing action structure 100 are not necessarily needed. As used herein, freestanding means that the support structure 102 stands alone on the underlying surface, however, the support structure 102 may be anchored to the underlying surface to reduce or prevent movement of the support structure 102. The support structures described herein can be used indoors or outdoors as required or desired.

The support structure 102 defines a height H. The height H is defined between the base 106 and the header 110. In the example, the columns 108 may have one or more modular sections 108*a-c* so that the height H of the support structure 102 can easily be adjustable as required or desired. As illustrated, the support structure 102 is about 26 feet tall, and as such, the participants can use the belays 122 (shown in FIG. 1). In other example, the support structure 102 may have a smaller height H (e.g., about 14 feet tall) so that it can be used for bouldering activates and belays may not be necessarily used. In either example, base padding (not shown) may cover the bases 106 and provide padding around the action elements for the participants. Other heights H are also contemplated herein such as 18 feet and 22 feet. By being able to define and standardize the height H of the support structure 102, the climbing action structure 100 can be sized to fit within existing building or areas, and customized action element sizes do not necessarily need to be created. It should be appreciated, however, the support structure 102 can have non-standardized heights as require or desired.

In the example, the first end 116 of the header 110 cantilevers from the column 108 and may extend further radially outward than the first end 112 of the base 106. This configuration enables for the belay 122 to be positioned relative to the action element so that its rope is restricted or prevented from undesirably rubbing against the action element. The first end 112 of the base 106 includes a base plate 128 so that the support structure 102 can be anchored to the underlying structure. Additionally, a mounting plate 130 is coupled to the top of the base 106 and extends inward toward the column 108 from the first end 112. This length L of the mounting plate 130 provides a plurality of locations for the action element to be selectively positioned relative to the column 108 such that the gap 120 (shown in FIG. 1) between the column 108 and the action element can be formed. Furthermore, by coupling the action element directly to the base 106, the efficiencies of positioning, removing, and attaching the action element to the action support 104 are increased compared to coupling the action element directly to the underlying structure. Attaching the action element directly to the underlying structure may require permanent modification of the underlying structure, which is often undesirable, but can be done.

A climbing action space 132 is defined at least partially by each action support 104 and between the base 106, the header 110, and the column 108. The climbing action space 132 is devoid of intruding structure and is configured to receive the action element that is removably coupled to the action supports 104. By defining the climbing action space 132 at least partially within the support structure 102 and disposing the action element therein, full 360° access is provided for the participants to each of the action elements.

In operation, each action element is coupled directly between the base 106 and the header 110 within the climbing action space 132 and can be replaced as required or desired. By making the action elements modular, it is easy to swap out and interchange the action elements and keep the climbing action structures new and exciting. Furthermore, the support structure can be configured to fit in a wide variety of facilities, indoor or outdoor, and without needing to tie into an existing structure. The support structure 102 enables the action elements to be supported within the climbing action space 132, thus, allowing the action elements to be dynamic and accessed from all sides to provide a unique three-dimensional, kinetic climbing experience.

Figure 4:
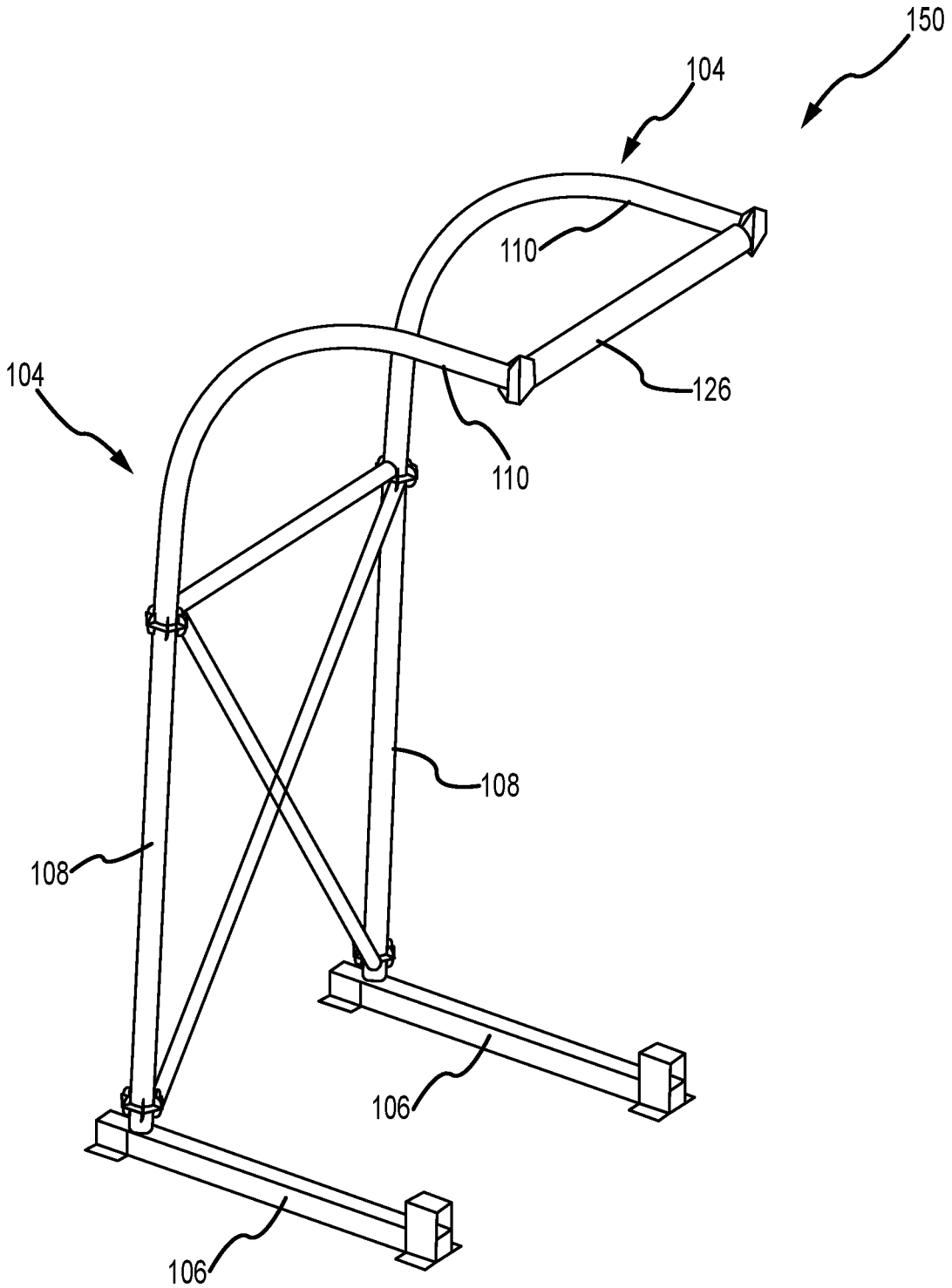
FIG. 4 is a perspective view of another example of a support structure.

FIG. 4 is a perspective view of another example of a support structure 150. Certain components are described above, and thus, are not necessarily described further. In this example, the support structure 150 includes a pair of parallel and spaced apart action supports 104. Similar to the example described above in FIGS. 1-3, the action elements are configured to be coupled to each action support 104 and extend between the base 106 and the header 110 while also being offset from the column 108 so as to enable 360° access for the participant on the action element. It should be appreciated that the support structure 150 can be expanded so that more than two action supports 104 are provided in a row (e.g., three, four, five, etc. action supports 104). In other examples, a single action support 104 may be utilized in the support structure.

Additionally, in the examples described herein the support structures (e.g., structure 102 (shown in FIGS. 1-3) and/or structure 150 (shown in FIG. 4) are configured so that two or more climbing action structures may be connected to one another with substantially horizontal members and participants can not only move vertically up and down the action elements, but also horizontally above ground and between support structures. For example, support beams (not shown) can be coupled between the first ends 112 of the headers 110 and allow participants to climb horizontally. Additionally, or alternatively, horizontal action elements can include zip lines, a ropes course, etc. supported by the columns 108 of the support structures. In an aspect, two or three support structures 102 with additional horizontal members so that some of the action supports 104 are used for action elements and vertical climbing action and some of the action supports 104 include the additional horizontal members and are used for horizontal climbing action.

FIG. 5 is a perspective view of yet another example of a support structure 175. Certain components are described above, and thus, are not necessarily described further. In this example, the support structure 175 has a canopy-like shape. The support structure 175 has a plurality of columns 177 and a plurality of headers 179. The columns 177 are configured to be fixed relative the underlying surface and support at least one header 179 above the underlying surface. For example, the support structure 175 has a center column 177*a* and a plurality of outer columns 177*b* and each header 179 extends between the center column 177*a* and an outer column 177*b*. This column 177/header 179 configuration can be considered an action support that is configured to support the action elements (not shown attached thereto) and so as to position the action elements circumferentially around the center column 177*a*. In this example, the action elements are configured to be coupled to the header 179 and extend down to the underlying surface. Because of the length of the header 179, the action element can be selectively spaced from both the center column 177*a* and the outer columns 177*b* so as to enable 360° access for the participant on the action element. In some examples, a base (not shown) may be positioned below the header 179 so as to support the action element from below. Additionally, crossbars 126 may extend between the columns 177 or headers 179 for lateral support. The crossbars 126 may also provide attachment locations for the belay 122 (shown in FIG. 1).

In this example, a climbing action space 181 is defined at least partially between the columns 177, the headers 179, and the underlying surface that is devoid of intruding structure. The climbing action space 181 is configured to receive the action element that is removably coupled to the support structure 175 and provide full 360° access around each action element for the participants. The headers 179 define one or more action element mounts 183 that are configured to receive and allow the action element to couple to the header 179 and within the climbing action space 181. As illustrated in FIG. 5, each header 179 includes two action element mounts 183, one proximate the center column 177*a* and one proximate the outer column 177*b* so that the support structure 175 can accommodate 12 action elements. The action element mounts 183 allow for the action element to be adjusted in position along the header 179.

FIG. 6 is a perspective view of still another example of a support structure 190 having a plurality of action elements 700, 800, 900, 1000. Certain components are described above, and thus, are not necessarily described further. In this example, the support structure 190 has an arch-like shape and allow one or more action elements (e.g., action elements 700, 800, 900, and 1000) to be coupled thereto for climbing. The support structure 190 has a plurality of columns 177 and a plurality of headers 179. The columns 177 are configured to be fixed relative the underlying surface and support at least one header 179 above the underlying surface. The support structure 190 has a relatively narrow footprint compared to the others described herein.

The climbing action space 181 is defined at least partially between the columns 177, the headers 179, and the underlying surface that is devoid of intruding structure. The climbing action space 181 is configured to receive the action element that is removably coupled to the support structure 190 and provide full 360° access around each action element for the participants. The headers 179 define one or more action element mounts 183 that are configured to receive and allow the action element to couple to the header 179 and within the climbing action space 181. The action element mounts 183 and the header 179 define a longitudinal axis 185 that is substantially parallel to the underlying surface. In the example, the action element mount 183 and the header 179 are formed as a tubular beam so that the action element can be adjustably positionable A along the longitudinal axis 185 as required or desired. The header 179 also defines belay sections 187 that are disposed adjacent the action element mount 183 along the longitudinal axis 185 that are configured to support the belay device 122. The belay sections 187 are also a tubular beam so that the belay 122 can be adjustably positionable A along the longitudinal axis 185. In some examples, the belay device 122 may be coupled to the belay section 187 with a rope wrapped around the header 179 so that its position can be adjusted as required or desired.

In this example, the action elements are configured to be coupled to the header 179 and extend down to the underlying surface. As such, the action elements are oriented substantially orthogonal to the header 179 and its longitudinal axis 185. In some examples, a base (not shown) may be positioned below the header 179 so as to support the action element from below. Additionally, lateral supports 192 may be used and coupled to an existing structure (e.g., building). The lateral supports 192 can extend from the headers 179. In other examples, the lateral supports 192 can extend to the underlying surface so that the support structure 190 is freestanding. In some examples, the lateral supports 192 can extend from the columns 177.

As illustrated in FIG. 6, further examples of the shape and size of action elements are described herein. For example, action element 700 is similar to the one illustrated in FIG. 11, however, the panel 702 is at least partially transparent so that two participants can see each other while climbing up opposite sides. The panel 702 can have holds 704 or any other vertical climbing element as required or desired. The action element 800 includes a plurality of panes 802 with one or more surfaces that a participant can climb using suction cups 804. Action element 800 is described further below in reference to FIG. 14. The action element 900 includes a plurality of vertical ropes 902 each having one or more climbing or activity features 904 such as rings, bars, handles so that a participant can climb up the ropes 902. Action element 900 is described further below in reference to FIG. 15. The action element 1000 includes one or more rope ladders 1002. Action element 1000 is described further below in reference to FIG. 16.

In the support structure examples described above and with respect to FIGS. 2-6, the support structures facilitate supporting the action elements in a variety of ways. The headers and the action element mounts are configured to receive the action element such that the action elements are installed and interchangeable without disassembly of the support structure. Additionally, the support structure enables the action elements to be spaced apart from one another such that the attached action elements are accessible from all sides within the support structure. The support structure also supports the belay devices so they can be independently interchangeable and positionable with respect to the action elements. This configuration increases ease of use and changeability of the action tower. The action elements can include any number of vertical climbing or activity features that add-on and allow the participant to climb between the top and bottom ends. These features can be interchangeable on the plurality of action elements to vary a participant's access with respect to the action elements. Some of the climbing or activity features can even move relative to the action element. In some aspects, at least a portion of the action elements can move themselves relative to the support structure. All of these different configurations of the action tower increase the climbing experience for the participant. FIGS. 14-18 described further below illustrate some examples of action elements with the understanding that further configurations can be generated by combining or removing one or more components as required or desired. Furthermore, the support structure can support two or more of the same or similar action elements, or support two or more completely different action elements.

Figure 7:
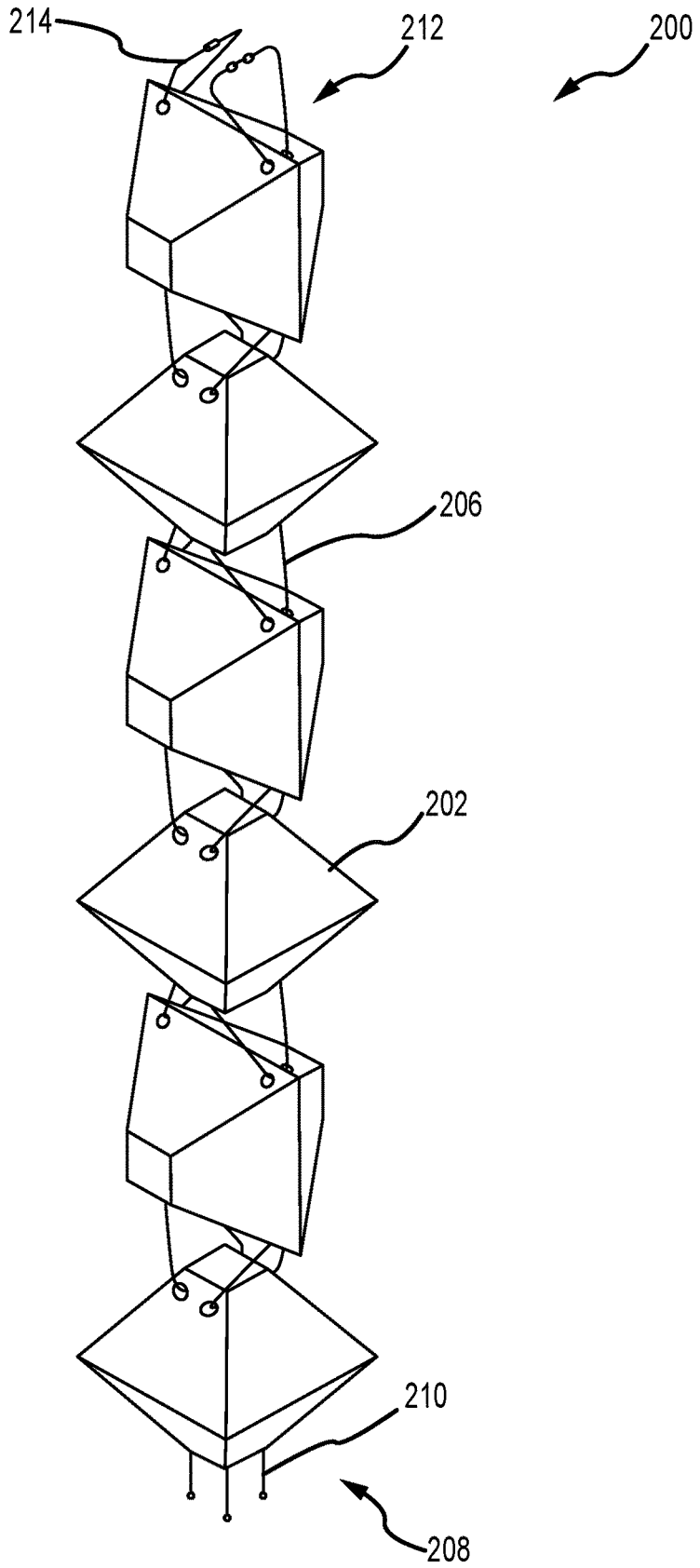
FIG. 7 is a perspective view of an exemplary action element.

FIG. 7 is a perspective view of an exemplary action element 200. The action element 200 is configured to removably couple to the support structure at the action element mount of the header. The action element 200 includes a plurality of floating volumes 202 (or other independent climbing elements) that are coupled together by ropes or cables 206. The floating volumes 202 have exterior surfaces where any number of climbing or activity features and/or holds (not shown) can be attached. Additionally, the ropes 206 enable the volumes 202 to move or swing relative to one another and the support structure. It should be appreciated that while geometric shapes are illustrated in FIG. 7, any number of the same or different shapes can be used as required or desired (e.g. circles, cubes, flat panels, etc.).

The action element 200 has a bottom end 208 that includes one or more base connection members 210 that are configured to couple to the mounting plate 130 of the base 106 (both shown in FIG. 2) or the underlying surface as required or desired. In an aspect, the base connection members 210 can be through bolts. The action element 200 also has a top end 212 that includes one or more header connection members 214 that are configured to couple to the header 110, 179 of the support structures described above. Both the base connection member 210 and the header connection member 214 enable the action element 200 to be coupled to the support structure without disassembly, and for the action element 200 to be slidably positioned at any location along the length of the header as required or desired. The base and header connection members 210, 214 enable the action element 200 to be supported by the structural support with the top and bottom ends 212, 208 fixed so that participants can climb on the action element. In this example, at least a portion of the action element 200 is movable and/or flexible relative to the structural support while being supported thereon.

In an aspect, the header connection members 214 can be a prusik loop connection knot using one or more flexible lines. In one example, the header connection members 214 can be coupled to the belay support 204 (shown in FIG. 1) that is then coupled to the header 110, 179. In other examples, the header connection members 214 can be coupled directly to the header 110,179. In this example, the belay 122 can then be supported directly by the support structure 102 (shown in FIG. 2). The ends 208, 212 of the action element 200 define the height of the action element 200 and the height can be set as required or desired for various height support structures. For example, one or more volumes 202 can be removed to lower the height of the action element 200, while one or more volumes 202 can be added to raise the height of the action element 200. Because the action element 200 is accessible from every direction for the participant, the support structure enables support such that 360° access is provided.

Figure 8:
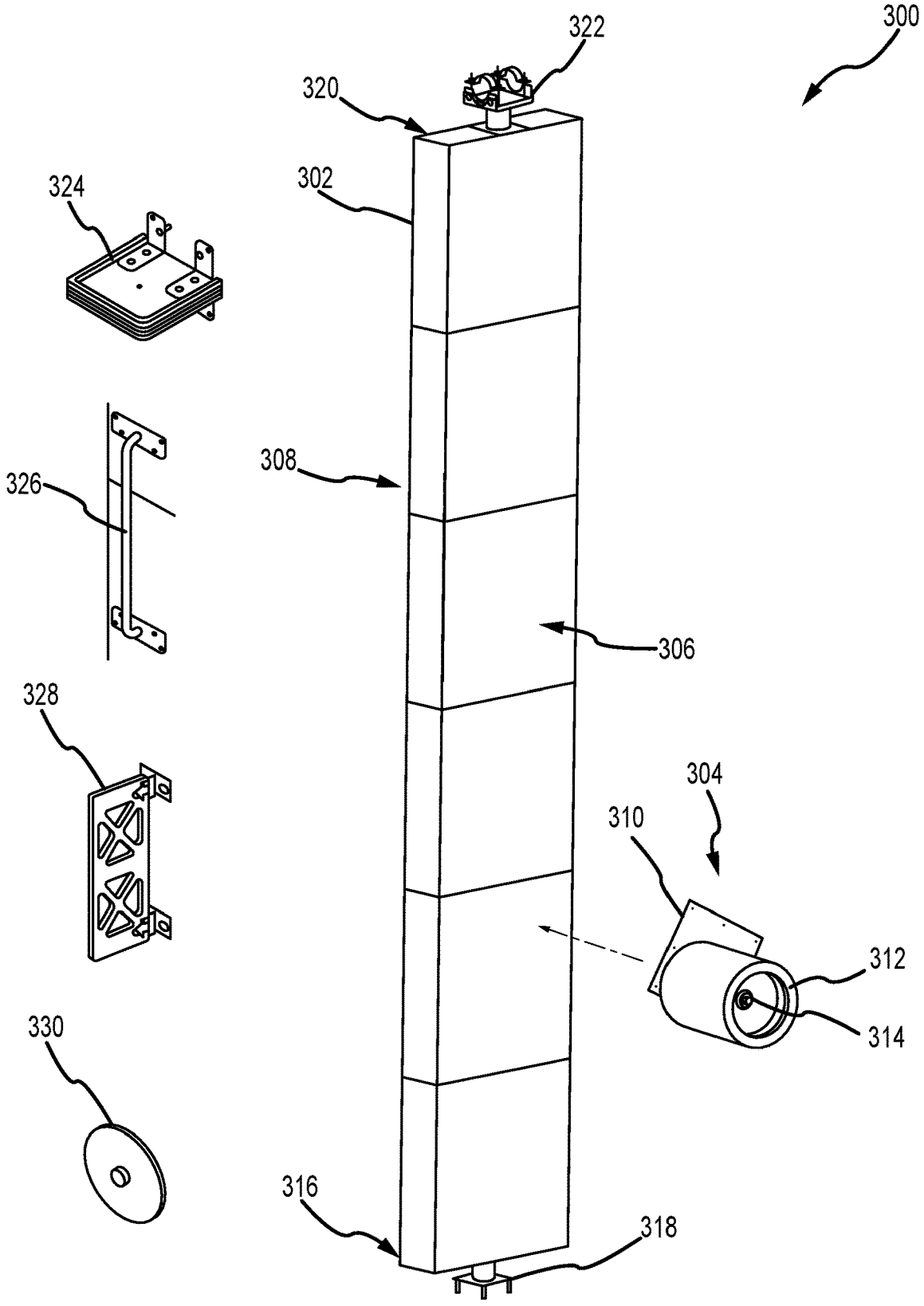
FIG. 8 is a perspective view of another action element.

FIG. 8 is a perspective view of another action element 300. The action element 300 is configured to removably couple to the support structure at the action element mount of the header. The action element 300 includes the panel 302 that is configured to support any number and configuration of climbing or activity features. In this example, the panel 302 is rigid and the features can be the rollers 304. The panel 302 is substantially rectangular with two opposing climbing surfaces 306, 308 that the rollers 304 can be coupled to. In some examples, the side surfaces between the climbing surfaces can be configured to have climbing or activity features coupled thereto. The roller 304 has a mounting plate 310 that secures to the climbing surface and a rotatable cylindrical tube 312 projecting therefrom. The cylindrical tube 312 may include a locking element 314 to selectively prevent rotation of the tube 312 relative to the plate 310. This can make climbing easier for the participant. A plurality of the rollers 304 can be coupled to either or both of the climbing surfaces 306, 308 and in any pattern as required or desired (see FIG. 1). By using both surfaces 306, 308 two participants can be climbing on either side of the panel 302. When two or more participants are using an action element, belay devices can be coupled to the support structure at each participant location.

The action element 300 has a bottom end 316 that includes one or more base connection members 318 that are configured to couple to the mounting plate 130 of the base 106 (both shown in FIG. 2) or directly to the underlying surface. In an aspect, the base connection member 318 can be a base plate for a bolted connection and a post to lift the panel 302 above the bolted connection. The action element 300 also has a top end 320 that includes one or more header connection members 322 that are configured to couple to the header 110, 179 of support structures described above. In an aspect, the header and base connection members 322, 318 are described further below in reference to FIGS. 12 and 13. In this example, the header connection member 322 is oriented so that the panel 302 runs parallel to the header. In other examples, the header connection member 322 can be oriented so that the panel 302 is orthogonal to the header as required or desired. The ends 316, 320 of the action element 300 define the height of the action element 300 and the height can be set as required or desired for various height support structures.

In this example, the panel 302 can additionally or alternatively accommodate any other climbing or activity feature other than the rollers 304 between the top and bottom end. For example, the rollers 304 can be a first set of add-on features. A different second set of add-on features can be one or more planes 324 or pipes 326. These planes and pipes can be mounted at different spots and angles on the panel 302 so the participant can push, pull, pivot, or perch on the features. In another aspect, a different second set of add-on features can be one or more doors 328 that vertically mount on the panel 302 and can pivot relative to the panel 302. In still another aspect, a different second set of add-on features can be one or more spinning discs 330, with each disc spinning freely relative to the panel 302. In yet other aspects, layers of circles (not shown) can be mounted to the panel 302 for climbing, or studs and dots (not shown) can be mounted to the panel 302 and form constellations for climbing. In all of these examples, the add-on climbing or activity features can be the same or different with each other and interchangeable on the panel 302 (e.g., via threaded bolt holes or the like). This interchangeability and modularity enable features and/or action elements to be swapped out to keep the climbing action structures fresh and exciting.

Figure 9:
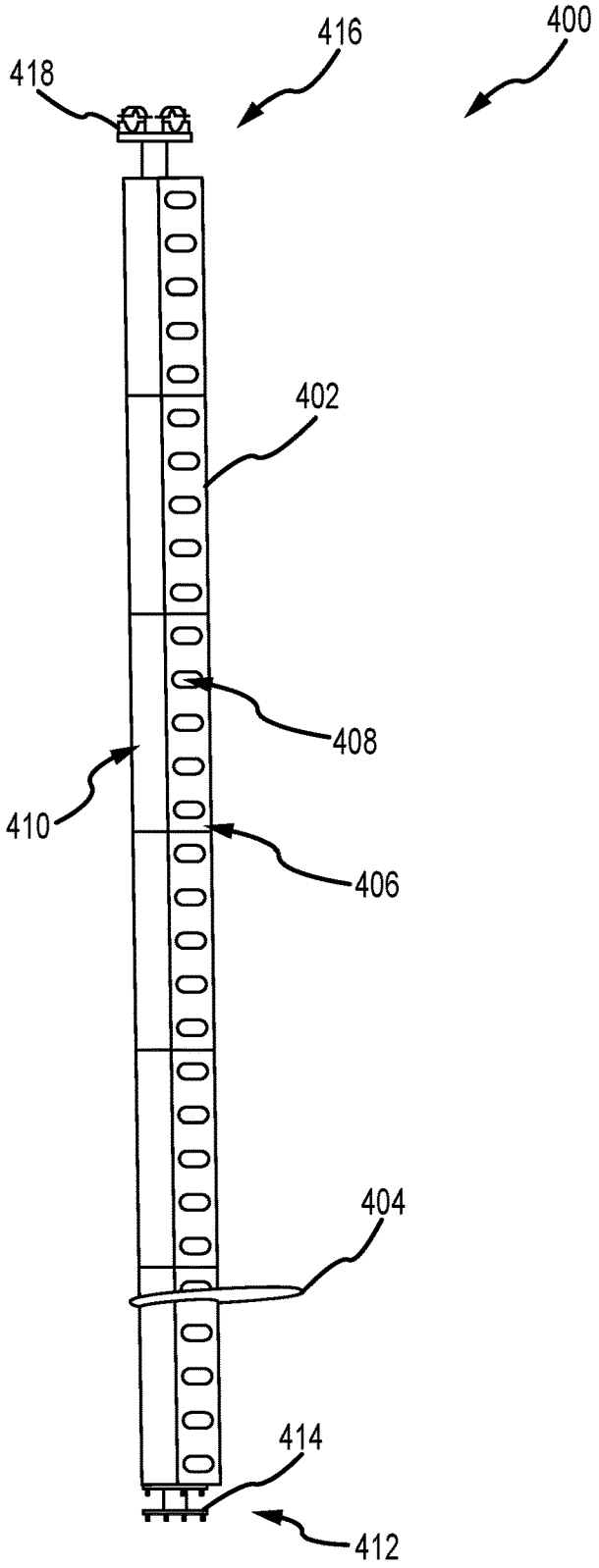
FIG. 9 is a perspective view of another action element.

FIG. 9 is a perspective view of another action element 400. The action element 400 is configured to removably couple to the support structure at the action element mount of the header. The action element 400 includes the log structure 402 that is rigid and the lasso 404 that is moveable with respect to the structure 402. The log structure 402 has a front surface 406 that has a plurality of horizontal slots 408 defined within. A rear surface 410 of the log structure 402 is curved. A participant can use the lasso 404 which is a webbing or a rope and the slots 408 to climb the log structure 402 similar to climbing a tree trunk or a telephone pole. In other examples, a participant can use just the slots 408 for movement as required or desired.

The action element 400 has a bottom end 412 that includes one or more base connection members 414 that are configured to couple to the mounting plate 130 of the base 106 (both shown in FIG. 2) or directly to the underlying surface. In an aspect, the base connection member 414 can be a base plate for a bolted connection and a post to lift the log structure 402 above the bolted connection. The action element 400 also has a top end 416 that includes one or more header connection members 418 that are configured to couple to the header 110, 179 of the support structures described above. In an aspect, the header and base connection members 418, 414 are described further below in reference to FIGS. 12 and 13. The ends 412, 416 of the action element 400 define the height of the action element 400 and the height can be set as required or desired for various height support structures.

Figure 10:
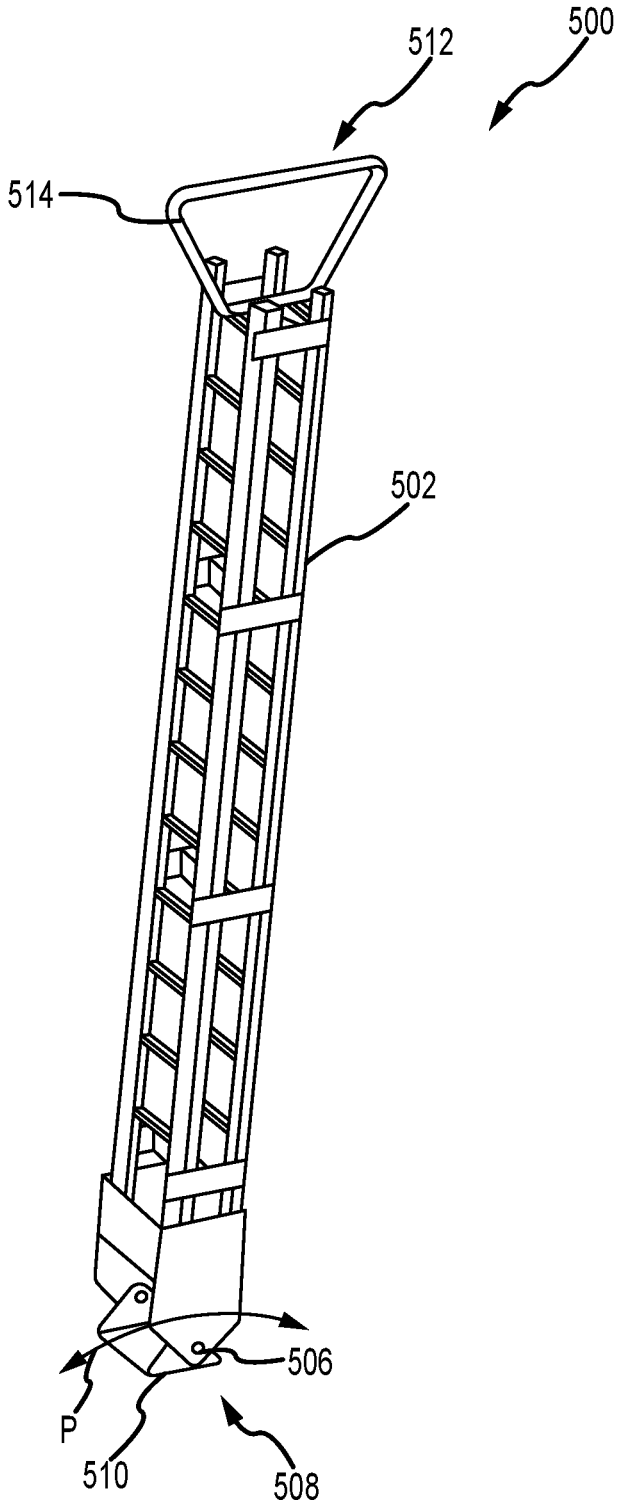
FIG. 10 is a perspective view of another action element.

FIG. 10 is a perspective view of another action element 500. The action element 500 is configured to removably couple to the support structure at the action element mount of the header. The action element 500 includes the ladder structure 502 that is pivotable P about a pivot point 506. In this example, the ladder structure 502 can have two opposing ladders for participants to use while the ladder structure 502 leans to and fro.

The action element 500 has a bottom end 508 that includes a base plate 510 that is configured to couple to the mounting plate 130 of the base 106 (both shown in FIG. 2) or directly to the underlying surface. The base plate 510 can also form the pivot point 506 that the ladder structure 502 can pivot about. In this example, by coupling the base plate 510 directly to the support structure, the pivot point 506 is formed directly on the support structure so that the movement of the action element 500 can be directly supported on the climbing action structure and it is easier to mount the belay device to accommodate the movement of the action element. In an aspect, the ladder structure 502 is movable relative the support structure and the bottom end 508.

The action element 500 also has a top end 512 that includes one or more header connection members 514 that are configured to couple to the header 110, 179 of the structural supports described above. In an aspect, the header connection members 514 can be a prusik loop connection knot using one or more flexible lines. This connection allows for the ladder structure 502 to pivot, but also uses the header connection members 514 to define the pivot distance to each side of the ladder structure 502. For example, shortening the header connection member 514 will reduce the pivot movement of the ladder structure 502, while lengthening the header connection member 514 allows the ladder structure 502 to sweep out a wider angle in either direction. Alternatively, the ladder structure 502 may be flipped upside down and coupled to the header as required or desired. In one example, the header connection members 514 can be coupled to the belay support 504 (shown in FIG. 1) that is then coupled to the header 110. In other examples, the header connection members 514 can be coupled directly to the header 110. The ends 508, 512 of the action element 500 define the height of the action element 500 and the height can be set as required or desired for various height support structures.

Figure 11:
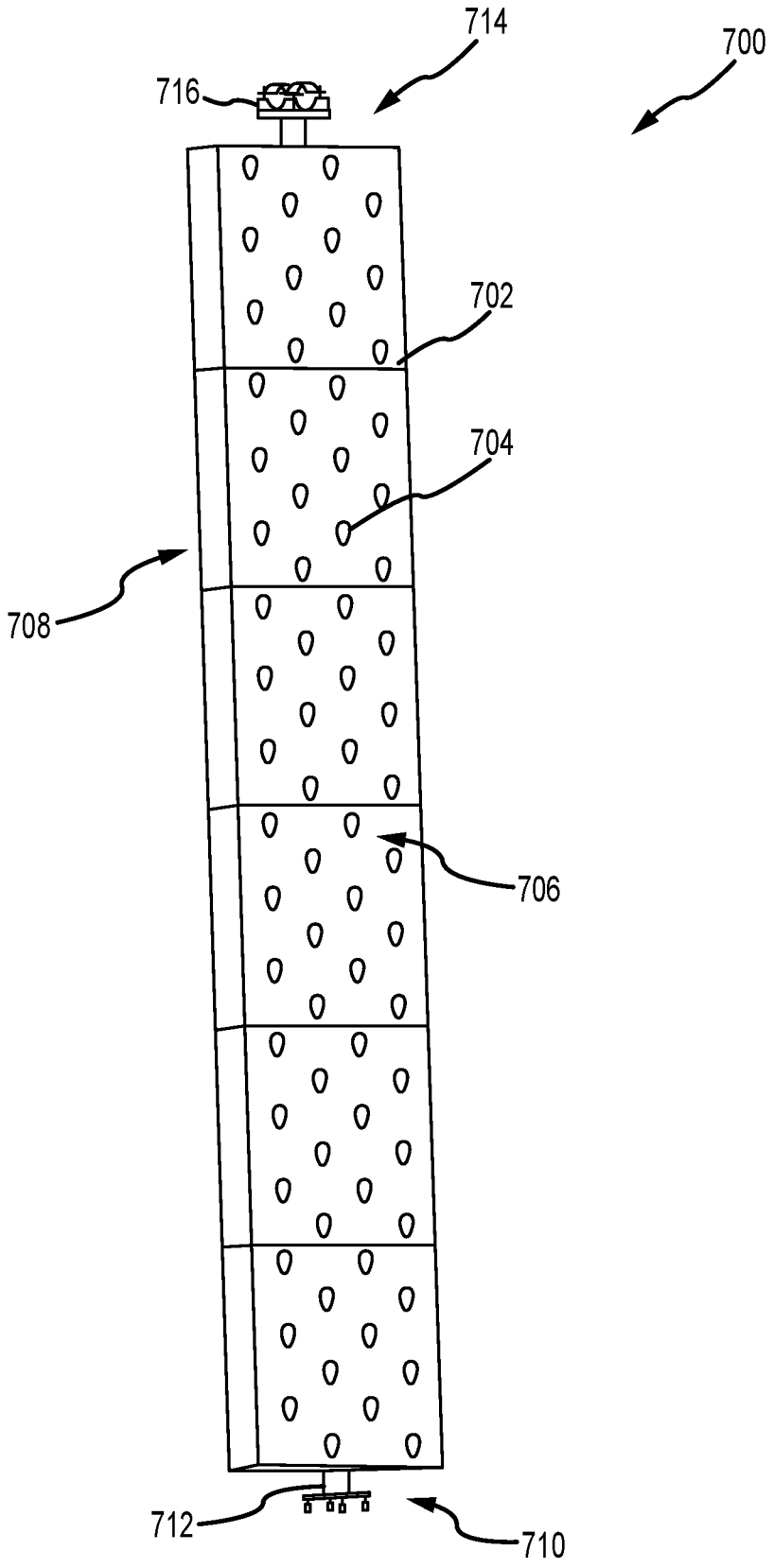
FIG. 11 is a perspective view of another action element.

FIG. 11 is a perspective view of another action element 700. The action element 700 is configured to removably couple to the support structure at the action element mount of the header. The action element 700 includes the panel 702 that is rigid and configured to support any number of climbing or activity features, for example, the features described with respect to FIG. 8. The panel 702 may be the same or similar to the panel 302 (shown in FIG. 8), however, the panel 702 includes other add-on features such as a plurality of climbing holds 704. The panel 702 is substantially rectangular with two opposing climbing surfaces 706, 708 that the holds 704 can be coupled to. In some examples, the side surfaces between the climbing surfaces can be configured to have add-on features coupled thereto. By using both surfaces 706, 708 two participants can be climbing on either side of the panel 702. In some examples, the climbing holds 704 may be configured to light up as required or desired. In other examples, the light may be responsive to contact from the participant to enable touch sensitive climbing and activity features. These lights can be programmable in color, sequence, intensity, etc.

The action element 700 has a bottom end 710 that includes one or more base connection members 712 that are configured to couple to the mounting plate 130 of the base 106 (both shown in FIG. 2) or the underlying surface. In an aspect, the base connection member 712 can be a base plate for a bolted connection and a post to lift the panel 702 above the bolted connection. The action element 700 also has a top end 714 that includes one or more header connection members 716 that are configured to couple to the header 110, 179 of the support structures described above. In an aspect, the header and base connection members 716, 712 are described further below in reference to FIGS. 12 and 13. In this example, the header connection member 716 is oriented so that the panel 702 is substantially orthogonal to the header. In other examples, the header connection member 716 can be oriented so that the panel 702 is substantially parallel to the header. The ends 710, 714 of the action element 700 define the height of the action element 700 and the height can be set as required or desired for various height support structures.

Figure 12:
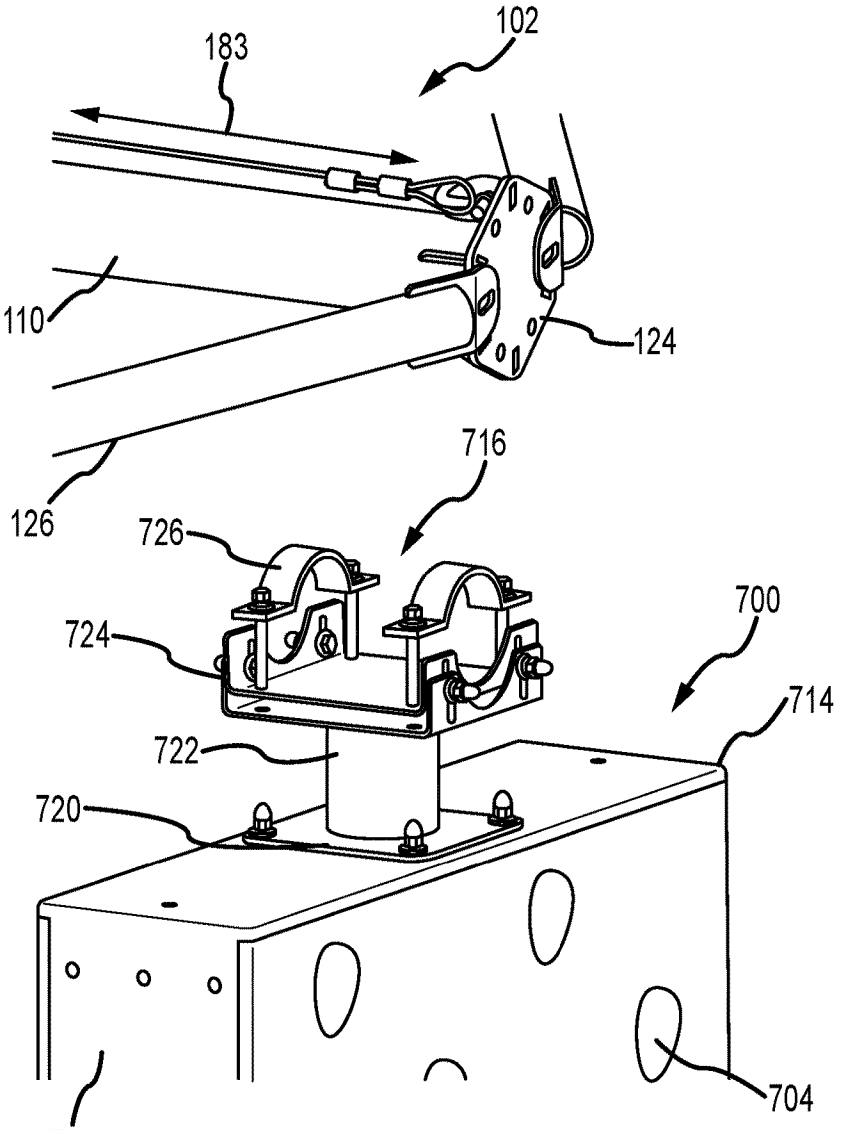
FIG. 12 is a perspective view of a header connection member between a support structure and an action element.

FIG. 12 is a perspective view of the header connection member 716 between the support structure 102 and the action element 700. Certain components are described above, and thus, are not necessarily described further. It should be appreciated that the header connection member 716 can be utilized with any of the action elements described herein and allow for at least a portion of the action element to be fixed relative to the support structure 102 (e.g., header 110, 179). The header connection member 716 is configured to be coupled to the header 110 of the support structure 102 and at the action element mount 183. In the example, the action element mount 183 is the portion of the header 110 that receives the header connection member 716 and allows the action element to be slidingly positionable so that the action element 700 can be positioned on the support structure 102 and allow for 360° access to the action element 700 by the participant. In the example, the free end of the header 110 includes the end plate 124 that is configured to support the belay device for the participant. In other examples, the belay device may be supported directly on the header 110 adjacent to the header connection member 716. As illustrated in FIG. 12, the header 110 is a tubular member so that its cross-sectional profile is constant within the action element mount 183. This configuration enables the adjustability of the action support without requiring disassembly of the support structure 102.

The header connection member 716 includes a top plate 720 that is configured to couple to the top end 714 of the panel 702 with a post 722 extending therefrom. Opposite the top plate 720, the header connection member 716 includes a pair of lower brackets 724 and a pair of upper brackets 726. A first bracket of the lower brackets 724 is directly coupled to the post 722 and fixed relative thereto. A second bracket of the lower brackets 724 is disposed at least partially within the first bracket. Each end of the lower brackets 724 have vertical elongated slots with bolts coupling the brackets 724 together. The pair of lower brackets 724 can be adjusted relative to one another in the vertical height direction so that the lower brackets 724 can be mounted underneath the header 110. At least a portion of the lower brackets 724 have a cutout that corresponds to the shape of the header 110. This configuration of the lower brackets 724 allow for the action element 700 to be coupled to and removed from the support structure 102 without disassembly. As such, even with the height of the action element 700, the header connection member 716 allows for the action element 700 to be installed and raised while swinging underneath the header 110. The configuration of the header connection member 716 also accommodates for the manufacturing tolerances of the support structure and so that the action elements can be attached thereto. Additionally, the header connection member 716 enable support loads to be transferred and borne by the support structure and not each individual action element.

The pair of upper brackets 726 are configured to be disposed above the header 110. The upper brackets 726 are oriented substantially perpendicular to the lower brackets 724 and each upper bracket 726 is coupled to the second bracket of the lower brackets 724 with threaded bolts. At least a portion of the upper brackets 726 are curved and correspond to the shape of the header 110 and to at least partially surround the header 110. The upper brackets 726 can be coupled to the lower brackets 724 from the top of the header 110 during installation. The header connection member 716 is configured to allow the action element 700 to be removably coupled to the support structure 102 without any disassembly of the support structure. This allows for the action elements to be easily replaced or repaired as required or desired. Additionally, the header connection member 716 can be slidingly positioned along the action element mount 183 on the header 110 as required or desired. The header connection member 716 enables the top end 714 of the action element 700 to be fixed relative to the support structure 102 and provide not only connection strength to support the action element 700 itself, but also the action element while being used by one or more participants.

As illustrated in FIG. 12, the header connection member 716 is oriented so that the panel 702 is substantially orthogonal to the header 110. It should be appreciated that the header connection member 716 can be rotated 90° relative to the panel 702 so that the panel 702 can be oriented substantially parallel to the header 110 and as illustrated in FIG. 8.

Figure 13:
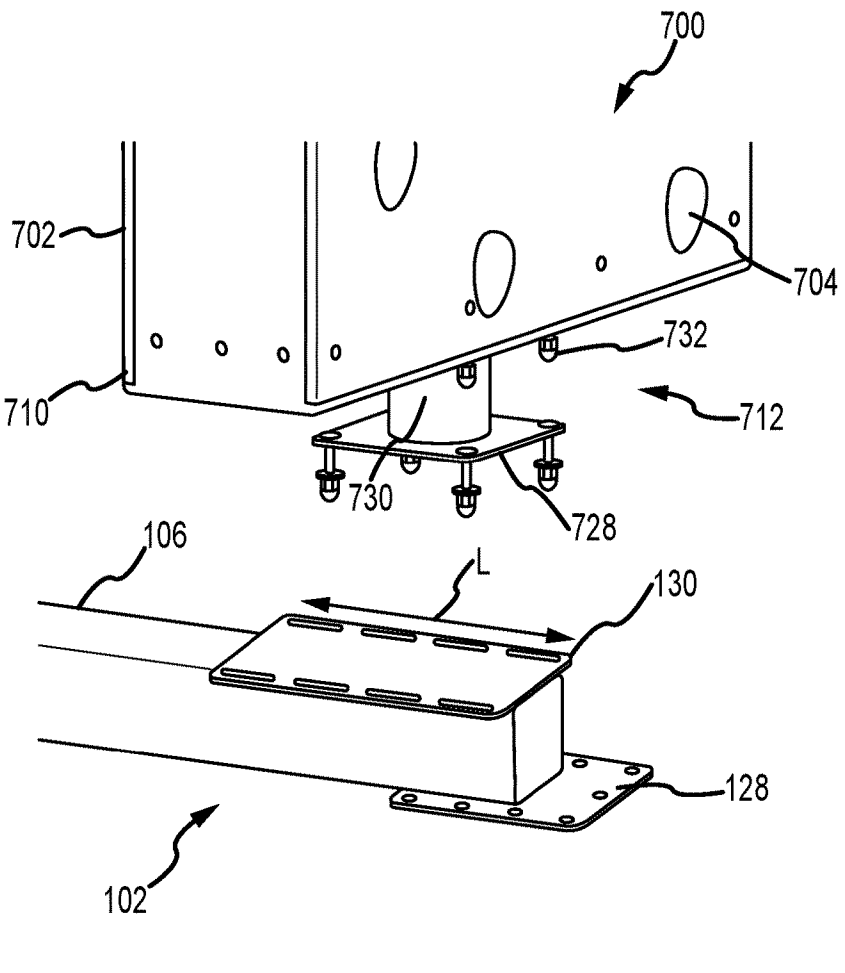
FIG. 13 is a perspective view of a base connection member between a support structure and an action element.

FIG. 13 is a perspective view of the base connection member 712 between the support structure 102 and the action element 700. Certain components are described above, and thus, are not necessarily described further. It should be appreciated that the base connection member 712 can be utilized with any of the action elements described herein and allow for at least a portion of the action element to be fixed relative to the support structure 102 (e.g., base 106) or the underlying surface as required or desired. The base connection member 712 is configured to be coupled to the base 106 of the support structure 102 at the mounting plate 130 or directly to the underlying surface as require or desired. Additionally, the base connection member 712 can couple to the mounting plate 130 at any number of positions along its length L (e.g., via holes) so that the action element 700 can be positioned on the support structure 102 and allow for 360° access to the action element 700 by the participant. In an aspect, the length L of the mounting plate 130 corresponding the length of the action element mount 183 of the above header 110 (shown in FIG. 12). In the example, by coupling the base connection member 712 of the action element 700 directly to the base 106, it is easier for the action element 700 to be installed, moved, and removed from the support structure 102. For example, the base connection member 712 does not directly interact with the underlying surface and is lifted above the underlying surface, thus enabling easier access for the installers.

The base connection member 712 includes a base plate 728 for a bolted connection (e.g., at the four corners of the plate) with the mounting plate 130 and a post 730 to lift the panel 702 above the bolted connection. By offsetting the bottom end 710 of the panel 702 from the connection between the action element 700 and the base 106, foam pads (not shown) can be positioned around the action element 700 for the participant. Additionally, easier access to the base plate 728 is provided. Opposite the base plate 728, the base connection member 712 includes another plate 732 to couple to the bottom end 710 of the panel 702. The base connection member 712 is configured to allow the action element 700 to be removably coupled to the support structure 102 without any disassembly of the support structure. This allows for the action elements to be easily replaced or repaired as required or desired. Additionally, the base connection member 712 can be slidingly positioned along the base 106 or the underlying surface as required or desired. The base connection member 712 enables the bottom end 710 of the action element 700 to be fixed relative to the support structure 102 and provide not only connection strength to support the action element 700 itself, but also the action element while being used by one or more participants.

Referring concurrently to FIGS. 12 and 13. The header connection member 716 and base connection member 712 can be any other connection types that enable the support structure 102 and action elements to function as described herein. By standardizing some of the connection members throughout all the different types of action elements, the efficiencies of manufacturing and changing out the action elements on the climbing action structure are increased. Additionally, the header and base connection members 716, 712 enable the action element 700 to be slidably positioned relative to the columns of the support structure so as to accommodate the belay devices and allow participant access to the action element within the climbing action space.

Figure 14:
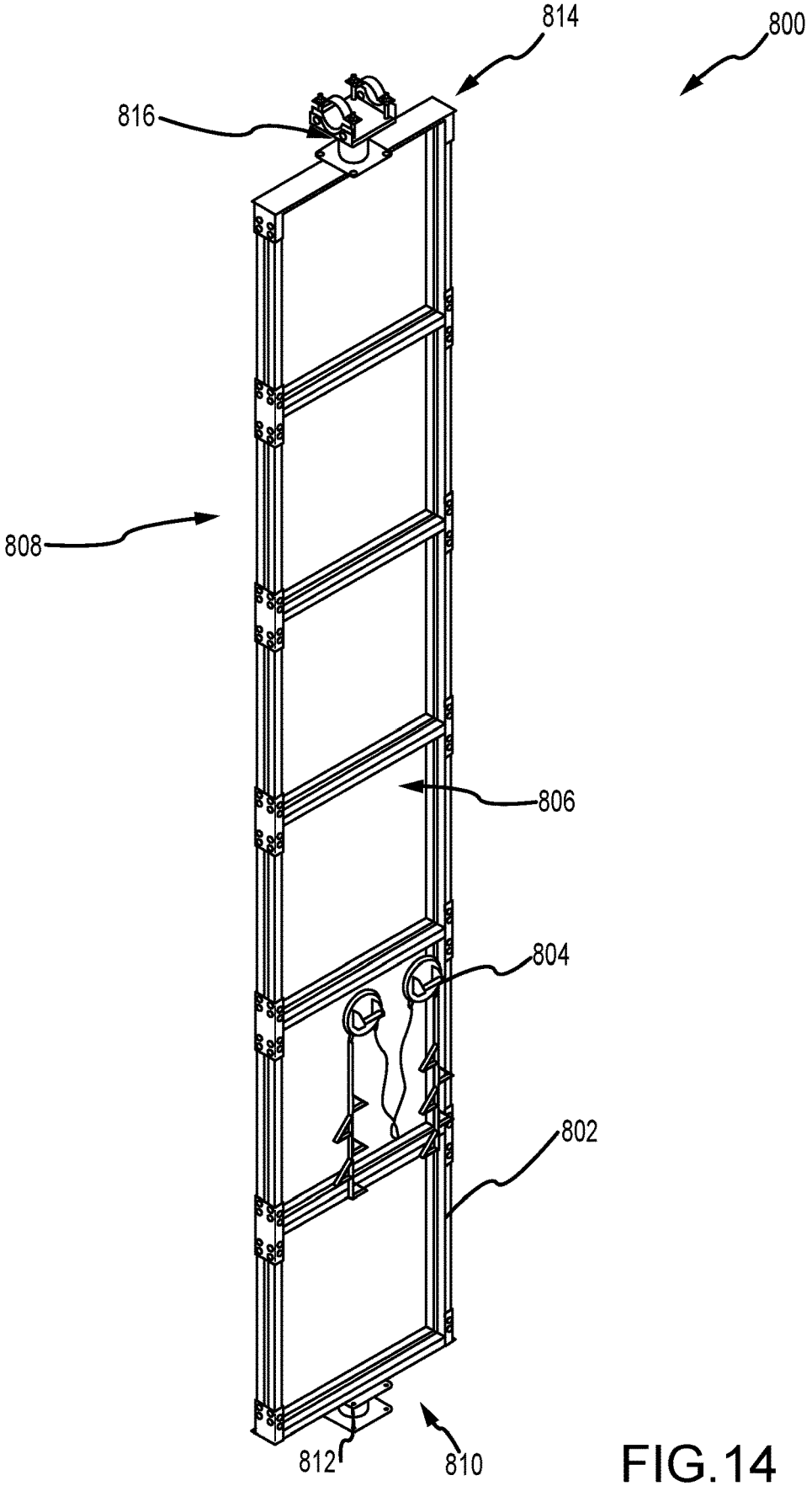
FIG. 14 is a perspective view of another action element.

FIG. 14 is a perspective view of another action element 800. The action element 800 is configured to removably couple to the support structure at the action element mount of the header. The action element 800 includes one or more panes 802 that are configured to support suction cups 804. The panes 802 are vertically arranged and have two opposing climbing surfaces 806, 808 that the participants can use. The suction cups 804 can include feet stirrups as required or desired.

The action element 800 has a bottom end 810 that includes one or more base connection members 812 that are configured to couple to the mounting plate 130 of the base 106 (both shown in FIG. 2) or the underlying surface. In an aspect, the base connection member 812 can be a base plate for a bolted connection and a post to lift the panes 802 above the bolted connection. The action element 800 also has a top end 814 that includes one or more header connection members 816 that are configured to couple to the header 110, 179 of the support structures described above. In an aspect, the header and base connection members 816, 812 are described further above in reference to FIGS. 12 and 13. The ends 810, 814 of the action element 800 define the height of the action element 800 and the height can be set as required or desired for various height climbing action structures.

Figure 15:
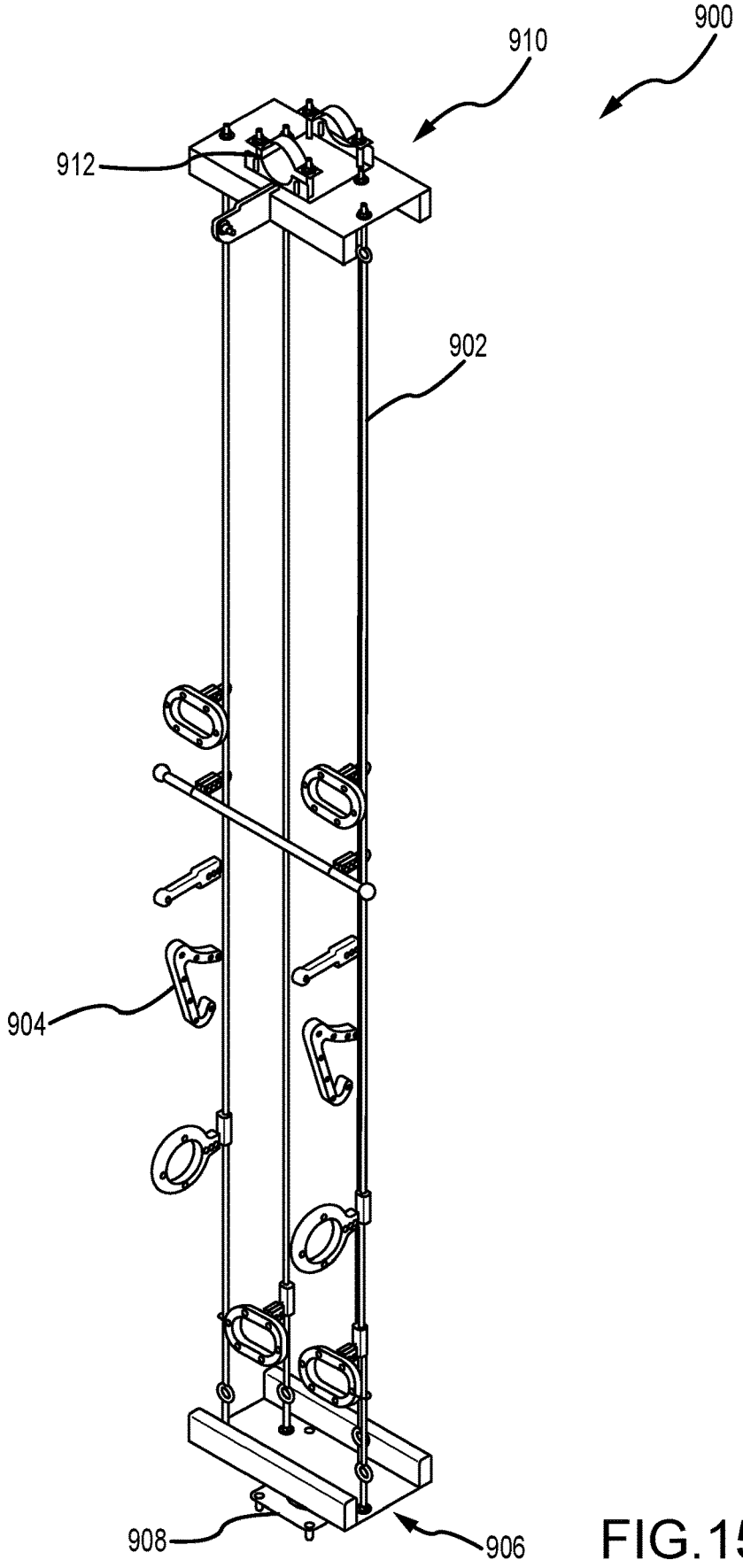
FIG. 15 is a perspective view of another action element.

FIG. 15 is a perspective view of another action element 900. The action element 900 is configured to removably couple to the support structure at the action element mount of the header. The action element 900 includes vertical ropes 902 each having one or more climbing or activity features 904 such as rings, bars, handles so that a participant can climb up the ropes 902. In this example, the ropes 902 can be taut and the features can be slidable along the rope 902 or removable and re-attachable as required or desired.

The action element 900 has a bottom end 906 that includes one or more base connection members 908 that are configured to couple to the mounting plate 130 of the base 106 (both shown in FIG. 2) or the underlying surface. In an aspect, the base connection member 908 can be a base plate for a bolted connection and a post to lift the ropes 902 above the bolted connection. The action element 900 also has a top end 910 that includes one or more header connection members 912 that are configured to couple to the header 110, 179 of the support structures described above. In an aspect, the header and base connection members 912, 908 are described further above in reference to FIGS. 12 and 13. The ends 906, 910 of the action element 900 define the height of the action element 900 and the height can be set as required or desired for various height climbing action structures.

Figure 16:
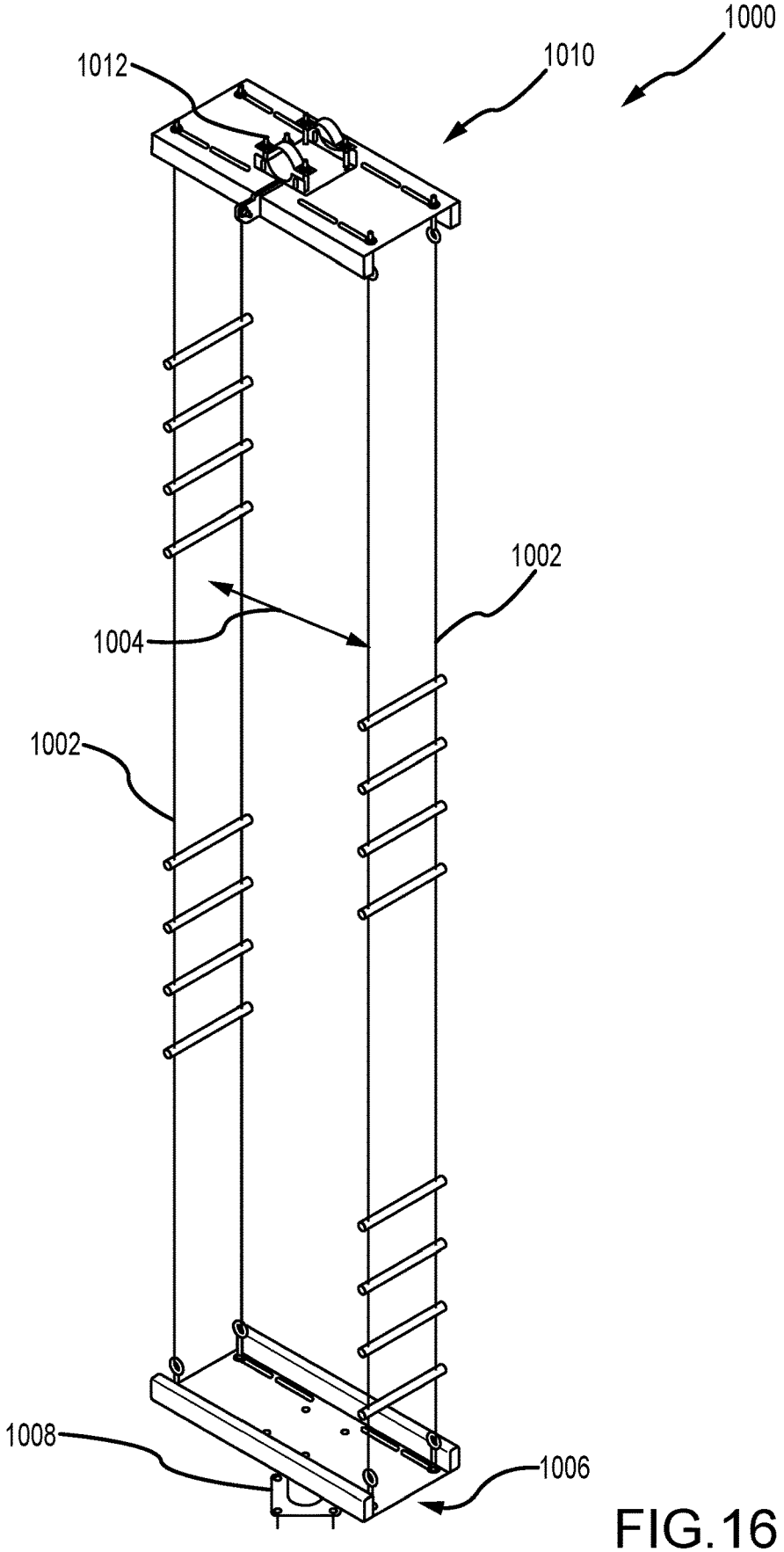
FIG. 16 is a perspective view of another action element.

FIG. 16 is a perspective view of another action element 1000. The action element 1000 is configured to removably couple to the support structure at the action element mount of the header. The action element 1000 includes one or more rope ladders 1002. In this example, two rope ladders 1002 are spaced apart 1004 and include sections of rungs and gaps so that the participant can transfer between the two. The spacing 1004 can be adjustable as required or desired. The rope ladders 1002 can be taut or allow some movement as required or desired. In other examples, one or more ropes (not shown) can be used. In still other examples, one or more rigid pipes can be used. As illustrated in in FIG. 16, the rope ladders 1002 are substantially parallel to each other, however, in other examples, the rope ladders 1002 can also be angled relative to one another so that the participant can climb a parallelogram or pyramid-like shape either with the rope ladders 1002 at an incline or forming an overhang.

The action element 1000 has a bottom end 1006 that includes one or more base connection members 1008 that are configured to couple to the mounting plate 130 of the base 106 (both shown in FIG. 2) or the underlying surface. In an aspect, the base connection member 1008 can be a base plate for a bolted connection and a post to lift the ladders 1002 above the bolted connection. The action element 1000 also has a top end 1010 that includes one or more header connection members 1012 that are configured to couple to the header 110, 179 of the support structures described above. In an aspect, the header and base connection members 1012, 1008 are described further above in reference to FIGS. 12 and 13. The ends 1006, 1010 of the action element 1000 define the height of the action element 1000 and the height can be set as required or desired for various height climbing action structures.

Figure 17:
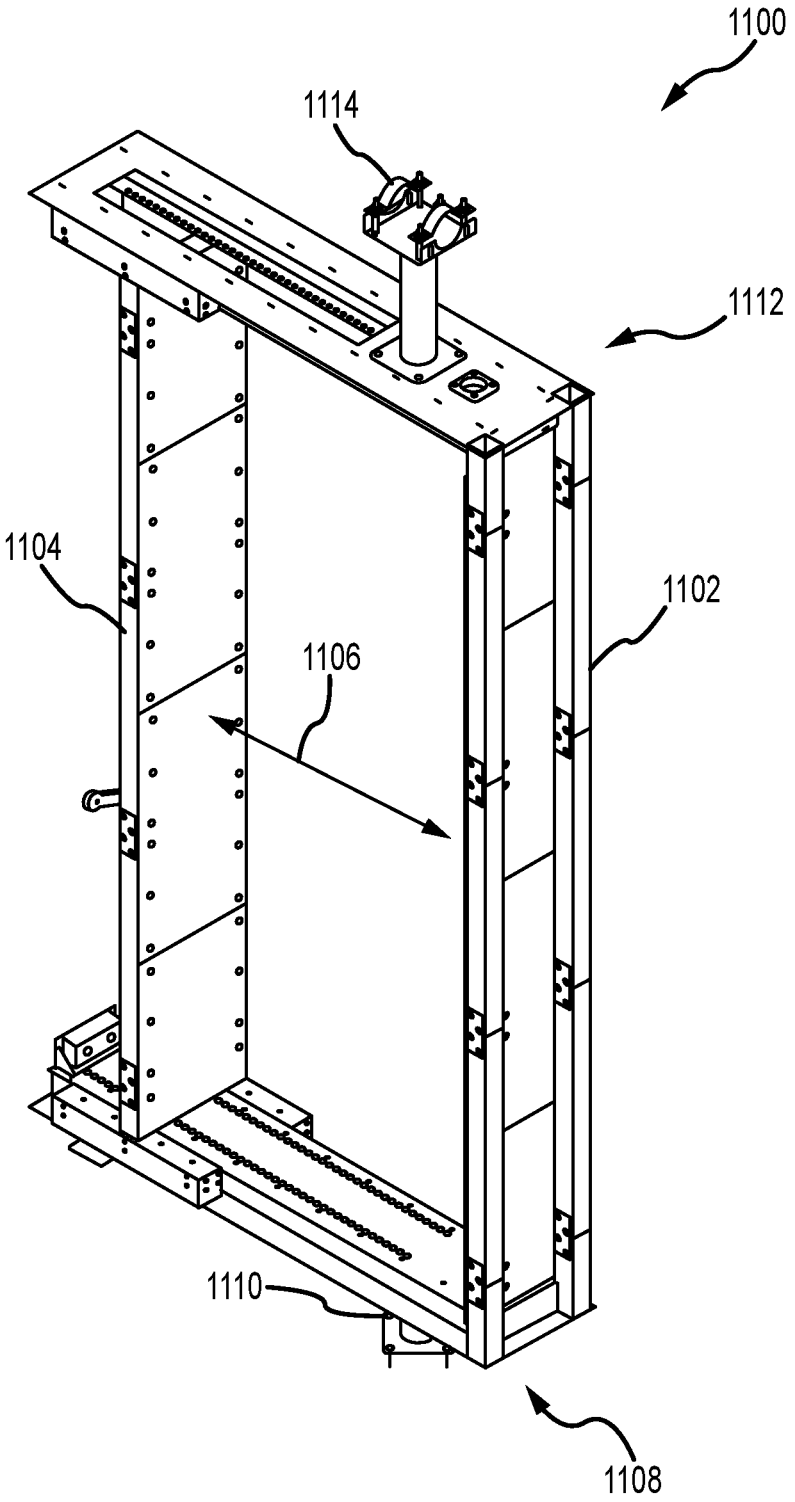
FIG. 17 is a perspective view of another action element.

FIG. 17 is a perspective view of another action element 1100. The action element 1100 is configured to removably couple to the support structure at the action element mount of the header. The action element 1100 includes a stationary wall 1102 and an adjustable wall 1104 forming an adjustable chimney space 1106 for the participant to climb. In this example, the spacing 1106 can be between 12 inches and 84 inches. The walls 1102, 1104 each have planar faces that oppose each other and remain substantially parallel for the participant.

The action element 1100 has a bottom end 1108 that includes one or more base connection members 1110 that are configured to couple to the mounting plate 130 of the base 106 (both shown in FIG. 2) or the underlying surface. In an aspect, the base connection member 1110 can be a base plate for a bolted connection and a post to lift the walls 1102, 1104 above the bolted connection. The action element 1100 also has a top end 1112 that includes one or more header connection members 1114 that are configured to couple to the header 110, 179 of the support structures described above. In an aspect, the header and base connection members 1114, 1110 are described further above in reference to FIGS. 12 and 13. The ends 1108, 1112 of the action element 1100 define the height of the action element 1100 and the height can be set as required or desired for various height climbing action structures.

Figure 18:
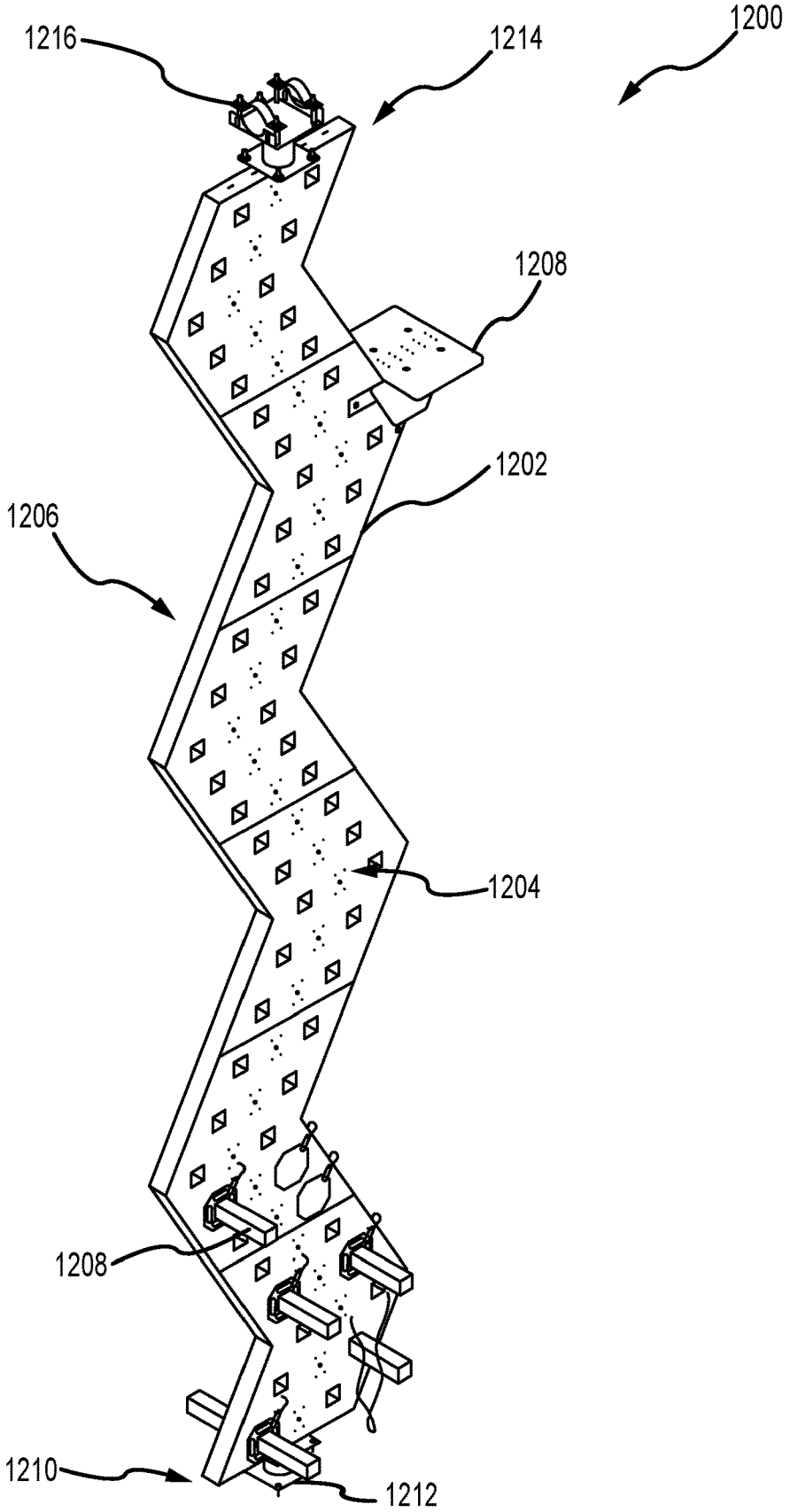
FIG. 18 is a perspective view of another action element.

FIG. 18 is a perspective view of another action element 1200. The action element 1200 is configured to removably couple to the support structure at the action element mount of the header. The action element 1200 includes a panel 1202 with opposing climbing surfaces 1204, 1206. The panel 1202 has a plurality of apertures that are configured to receive one or more climbing or activity features 1208 such as planks of varying lengths that the participant can selectively place like a puzzle.

The action element 1200 has a bottom end 1210 that includes one or more base connection members 1212 that are configured to couple to the mounting plate 130 of the base 106 (both shown in FIG. 2) or the underlying surface. In an aspect, the base connection member 1212 can be a base plate for a bolted connection and a post to lift the panel 1202 above the bolted connection. The action element 1200 also has a top end 1214 that includes one or more header connection members 1216 that are configured to couple to the header 110, 179 of the support structures described above. In an aspect, the header and base connection members 1216, 1212 are described further above in reference to FIGS. 12 and 13. The ends 1210, 1214 of the action element 1200 define the height of the action element 1200 and the height can be set as required or desired for various height climbing action structures.

The action elements described above are major climbing elements that are utilized for attachment directly to the support structure that also supports the belay device. The participants can climb directly on the major climbing elements as required or desired. These major climbing elements can be fixed and/or rigid with respect to the support structure or have some relative movement. Additionally, the action elements are configured to support any number of minor climbing or activity features for the participant to interact with during use. These minor climbing or activity features can be interchangeable on the major climbing elements so that participants can have new configurations to climb. The minor climbing or activity features can be fixed holds or enable relative movement to give participants a three-dimensional, kinetic climbing experience. The adjustability and configurability of the action elements and the climbing or activity features allow the difficulty of climbing to be adjusted as required or desired and by two sets of components. The action elements can be rated by difficulty and the climbing or activity features can be rated by difficulty so that each action element can be adjusted for climbing difficulty.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In this regard, any number of the features of the different embodiments described herein may be combined into one single embodiment and alternate embodiments having fewer than or more than all of the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While various embodiments have been described for purposes of this disclosure, various changes and modifications may readily suggest themselves to those skilled in the art and may be made which are well within the scope of the present disclosure.

What is claimed is:

1. A climbing action structure comprising:

a support structure comprising a plurality of columns and a plurality of headers, the plurality of columns configured to be fixed relative to an underlying surface and support at least one header of the plurality of headers extending therefrom and above the underlying surface, and a climbing action space is defined at least partially between the plurality of columns, the plurality of headers, and the underlying surface that is devoid of intruding structure, wherein the plurality of headers and the plurality of columns define a plurality of action supports, each of the plurality of headers are substantially parallel to the underlying surface; and at least one action element configured to be removably coupled to the support structure at a respective action support of the plurality of action supports, wherein the at least one action element comprises a top end having a header connection member and an opposite bottom end having a base connection member, the header connection member being coupled to the respective header, wherein the header connection member and the base connection member allow for the at least one action element to be slidably positioned at any location along the longitudinal axis a length of the header, and wherein the at least one action element is disposed within the climbing action space and a participant has 360° access to the at least one action element therein.

2. The climbing action structure of claim 1, wherein the plurality of headers also define a plurality of belay sections configured to support a belay device for the participant, and wherein at least one belay section of the plurality of belay sections are disposed adjacent the at least one action element.

3. The climbing action structure of claim 1, wherein the header connection member comprises a pair of upper brackets disposed above the respective header and a pair of lower brackets disposed below the respective header, and the header connection member couples to and is removed from the respective header without disassembly of the support structure.

4. The climbing action structure of claim 1, wherein the at least one action element extends between the respective header and the underlying surface, and is oriented substantially orthogonal to the length of the header.

5. The climbing action structure of claim 1, wherein the base connection member comprises a base plate to fix the at least one action element to the underlying surface and a post that lifts the bottom end off the underlying surface.

6. The climbing action structure of claim 1, further comprising a plurality of climbing features disposed between the top end and the bottom end of the at least one action element.

7. The climbing action structure of claim 6, wherein the plurality of climbing features comprises a first set of climbing features and a different second set of climbing features, the first set and second set of climbing features being interchangeable on the at least one action element.

8. The climbing action structure of claim 6, wherein the at least one action element is fixed relative to the support structure and one or more of the plurality of climbing features are movable relative to the at least one action element.

9. The climbing action structure of claim 6, wherein the top end and the bottom end of the at least one action element is fixed relative to the support structure, and at least a portion of the at least one action element is movable relative to the top and bottom ends.

10. The climbing action structure of claim 6, wherein the at least one action element comprises a first action element and a second action element, and wherein the plurality of climbing features are different between the first and second action elements.

11. A climbing action structure comprising:

a support structure comprising a plurality of action supports, each action support comprising:

a base;

a header; and a column extending between the base and the header, wherein the header is cantilevered from the column and a climbing action space is defined at least partially between the base, the header, and the column that is devoid of intruding structure, and wherein the header is substantially parallel to the base; and an action element configured to be removably coupled to the support structure at a respective action support of the plurality of action supports, wherein the action element is coupled directly between the base and the header within the climbing action space, and is offset from the column so that a participant has 360° access to the action element, wherein the action element comprises a top end having a header connection member and an opposite bottom end having a base connection member, and wherein the header connection member and the base connection member allow for the action element to be slidably positioned at any location along a length of the header.

12. The climbing action structure of claim 11, wherein the support structure is freestanding.

13. The climbing action structure of claim 11, wherein each of the plurality of action supports extend radially outward from a center point such that each action element is circumferentially spaced from one another.

14. The climbing action structure of claim 11, wherein a free end of the header comprises an end plate configured to support a belay device for the participant.

15. An action tower comprising:

a freestanding support structure, wherein the support structure defines a plurality of action element mounts, each of the plurality of action element mounts include a header extending from at least one column;

a plurality of action elements configured to couple to the freestanding support structure at a respective action element mount of the plurality of action element mounts, wherein each of the plurality of action elements are supported at top and bottom ends with respective header and base connection members, wherein each of the plurality of action elements are interchangeable with one another at the respective action element mount, and wherein each of the plurality of action elements are spaced apart from one another such that the attached action element is accessible from all sides within the freestanding support structure, and wherein the header and base connection members allow for each of the plurality of action elements to be slidably positioned at any location along a length of the header; and a plurality of vertical activity features disposed on the plurality of action elements that are configured to allow access between the top and bottom ends, wherein the plurality of vertical activity features are interchangeable on the plurality of action elements to vary a participant's access to the plurality of action elements.

16. The action tower of claim 15, wherein at least one of the plurality of action elements comprises a substantially rectangular panel, the substantially rectangular panel having two opposing surfaces configured to receive at least some of the plurality of vertical activity features.

17. The action tower of claim 16, wherein the at least some of the plurality of vertical activity features pivot, rotate, or spin relative to the substantially rectangular panel.

18. The action tower of claim 15, wherein the respective action element mount comprises at least one belay section configured to support a belay device proximate the attached action element of the plurality of action elements.

19. The action tower of claim 15, wherein the freestanding support structure is greater than or equal to 14 feet in height.

* * * * *